US007803095B1

(12) United States Patent
LaGree

(10) Patent No.: US 7,803,095 B1
(45) Date of Patent: Sep. 28, 2010

(54) EXERCISE MACHINE

(76) Inventor: Sebastien A. LaGree, 9230 Swallow Dr., Los Angeles, CA (US) 90069

( * ) Notice: Subject to any disclaimer, the term of this patent is extended or adjusted under 35 U.S.C. 154(b) by 0 days.

(21) Appl. No.: 11/894,304

(22) Filed: Aug. 20, 2007

Related U.S. Application Data

(60) Provisional application No. 60/838,753, filed on Aug. 18, 2006.

(51) Int. Cl.
*A63B 26/00* (2006.01)

(52) U.S. Cl. ..... 482/140; 482/121; 482/72

(58) Field of Classification Search ..... 482/121, 482/142, 140, 70–71, 79, 34, 139
See application file for complete search history.

(56) References Cited

U.S. PATENT DOCUMENTS 3,770,267 A * 11/1973 McCarthy ..... 482/130
3,892,404 A * 7/1975 Martucci ..... 482/96
5,653,670 A 8/1997 Endelman
5,681,249 A 10/1997 Endelman
5,792,033 A 8/1998 Marrithew
5,906,564 A * 5/1999 Jacobsen ..... 482/96
6,120,425 A 9/2000 Endelman
6,338,704 B1 1/2002 Endelman
6,527,685 B2 * 3/2003 Endelman et al. ..... 482/121
6,595,902 B1 * 7/2003 Savage et al. ..... 482/94
6,651,281 B1 11/2003 Figiel
6,805,409 B2 * 10/2004 Parker ..... 297/377
6,971,976 B2 * 12/2005 Endelman et al. ..... 482/121
7,029,425 B2 * 4/2006 Krull ..... 482/94

* cited by examiner

*Primary Examiner*—Lori Baker
(74) *Attorney, Agent, or Firm*—Todd N. Hathaway

(57) ABSTRACT

An exercise machine that enables a user to perform a variety of repetitive exercises in reclined, sitting and standing positions. The machine permits a user to perform exercises not possible on a traditional Pilates Reformer machine. The machine includes a frame with parallel side rails formed of extrusions, with a carriage that is mounted for rolling movement along the frame. A plurality of tension springs are selectively detachable/attachable to the end of the frame, to allow the user to decrease/increase the tension on the carriage. Angularly adjustable crossbars are mounted at both the head and foot ends of the frame, as are stationary platforms for the user's feet and/or hands; in addition, a raised transverse bar is mounted at the head end of the rolling platform. The combination of platforms and bars enables the user to perform a variety of exercises in standing positions. The frame includes legs that raise the side rails above the floor. A barbell rack and storage tray are mounted between the rails so as to be positioned generally beneath the frame, and are accessible vertically through the open space between the rails when the rolling platform is retracted by the springs to the foot end of the assembly.

24 Claims, 30 Drawing Sheets

EXERCISE MACHINE

RELATED CASES

This application claims the priority of Provisional Patent Application Ser. No. 60/838,753, filed Aug. 18, 2006.

BACKGROUND a. Field of the Invention

The present invention relates generally to machines for performing physical exercises, and more particularly, to an improved exercise machine that enables the user to perform a variety of repetitive exercises in reclined, sitting and standing positions.

b. Related Art

The present invention relates to the Pilates Method physical fitness system, which provides the ability to perform certain exercises not heretofore possible with conventional Pilates equipment.

By way of background, the Pilates Method physical fitness system was initially developed by Joseph Pilates. A German national of Greek decent, Pilates conducted physical fitness training for police officers in Britain prior to World War I. Pilates was also trained as a nurse, and while interned in Britain during World War I he investigated ways to rehabilitate bedridden victims of the 1918 influenza pandemic. The system that he developed consequently utilized a series of movements that could be practiced within the confines of a hospital or other rehabilitation environment. The principal piece of equipment, the Pilates Reformer, was in turn based on an old hospital bed, with some resemblance to earlier rowing machines.

In the Pilates Method, persons for the most part use their own bodies as "weights" in training, to build strength and flexibility. The method emphasizes proper alignment, centering, concentration, control, precision, breathing, and flowing movement, which result in increased flexibility, strength, muscle tone, body awareness, energy, and improved mental concentration. The method continues to be used in the rehabilitation process, but is most often practiced for purposes of personal fitness.

As befits its humble origins, the Pilates Reformer is a relatively simple piece of equipment. Although minor differences exist, depending on make and model, the basic components are essentially the same: A stationary frame supports a platform that slides back and forth on tracks, with resistance being provided by elastic cords or springs. A foot bar is mounted at one end of the frame and shoulder pads are mounted on the platform, so that a person can perform leg exercises while reclined on the platform. A pair of ropes are routed over pulleys at the head end of the frame, so that the person in turn can perform arm and upper body exercises while seated on the platform.

While the Reformer has proven highly successful for its intended purpose, it is not without limitations. To begin with, its ability to conduct exercises other than those listed above is very limited. For example, few, if any, exercises can be performed while standing, rather than in a seated or prone position. As a result, certain muscle groups cannot be effectively exercised using the Reformer alone. Joseph Pilates designed other pieces of equipment to conduct exercises not possible with the Reformer (e.g., the "Cadillac", the "Pedipull", the "Highchair", the "Lowchair" and the "Spine Corrector Barrel"), but additional equipment also means additional cost and space. These latter are particularly significant drawbacks in modern exercise and workout facilities, which allow people to exercise in groups under the tutelage of a single instructor, as opposed to the "one-on-one" gyms more popular in Joseph Pilates' day. Moreover, certain beneficial exercise motions are difficult or impossible to perform even with the additional pieces of Pilates equipment noted above.

A somewhat more subtle drawback of the conventional Reformer machine relates to an evolving divergence in philosophy from the traditional Pilates Method. As noted above, the principle objectives of the conventional Pilates Method are flexibility, strength and balance. Although very desirable goals in themselves, persons engaged in modern fitness regimes very frequently wish to achieve enhanced physical aesthetics as well; specifically, individuals often wish to increase muscle mass in certain areas, such as the pectoral, glutial and abdominal muscles, for example. The original Pilates Method is founded on a comparatively small number of repetitions of precisely controlled movements, to which the conventional Reformer machine is tailored, but such a regimen does not significantly increase muscle mass beyond a relatively limited point. Hence, the traditional Reformer machine is in some respects incapable of achieving the goals of many modern fitness programs.

Accordingly, there exists a need for an exercise machine that allows a person to perform the exercises of which a conventional Pilates Reformer is capable, plus additional exercises in the standing, seated and reclined positions. Furthermore, there exists a need for such an exercise machine that enables the person to perform exercises that effectively increase mass in various muscle groups, in order to achieve the goal of improved physical aesthetics. Still further, there exists a need for such an exercise machine that is well suited to use in the environment of a modern exercise studio or similar facility, and that allows the desired exercises to be performed by a group of individuals using a single type of machine, thus avoiding the cost and space required to supply the users with multiple types of machines.

SUMMARY OF THE INVENTION

The present invention has solved the problems cited above, and is an exercise machine on which a user can conduct a variety of repetitive exercises, in reclined, sitting and standing positions.

In a broad aspect, the machine comprises (a) a generally horizontal frame, (b) a carriage assembly mounted for longitudinal movement on the frame, (c) at least one tension spring that yieldingly biases the carriage assembly towards a foot end of the frame, (d) a first platform mounted at the foot end of the frame, (e) a second platform mounted at an opposite, head end of the frame, (f) a first angularly adjustable transverse bar mounted to the frame proximate the foot end thereof, and (g) a second angularly adjustable transverse bar mounted to the frame proximate the head end thereof.

The machine may further comprise first and second ropes having first ends that attach to the carriage assembly and second ends for being pulled by a user, and pulleys that are mounted proximate the head end of the frame and over which the ropes are routed, so that the user can exercise by pulling on the second ends of the ropes against tension offered by the at least one spring. The pulleys may comprise pair of pulleys mounted in vertically spaced relationship on first and second stanchions located proximate the head end of the frame. The machine may further comprise first and second angled-axis pulley wheels that are mounted to opposite sides of the frame, over which the ropes may be selectively routed so as to position the second ends thereof at locations that are outwardly angled from the sides of the carriage assembly. The machine may further comprise first and second horizontal-axis pulley wheels that are mounted to opposite sides of the frame at locations proximate the angled-axis pulley wheels, over which the ropes may be routed so as to position the second ends thereof at locations adjacent the platform at the head end of the machine.

The frame of the machine may comprise first and second spaced apart, generally parallel frame rails. The machine may further comprise at least one barbell rack that is mounted transversely across the frame rails so as to be positioned generally beneath the frame. The at least one barbell rack may be mounted proximate the head end of the frame, so as to accessible through the frame when the carriage assembly is retracted to the foot end of the machine by the at least one tension spring.

The machine may further comprise a storage tray mounted beneath the frame rails proximate the head end of the frame.

The carriage assembly may comprise a generally horizontal platform and first and second upwardly projecting the shoulder posts mounted proximate a head end the platform. The carriage assembly may further comprise a raised transverse bar mounted across the head end thereof, for being engaged by the user's hands or feet. The assembly may further comprise at least one traction pad mounted on the platform proximate the transverse bar, for forming an anti-slip engagement with the user's shoes. The assembly may further comprise a second traction pad mounted to the platform proximate a foot end thereof, also for forming an anti-slip engagement with the user's shoes.

The carriage assembly may further comprise first and second flange portions on opposite sides of the platform, and at least one attachment feature on each of said flange portions for connection of one of the ropes thereto. The attachment features may comprise a cam cleat and fairhead mounted to each of the flange portions. The flange portions may be angled outwardly and downwardly, and the attachment features may be mounted on the undersides thereof, so as to avoid obstructing arm movements when the user is on the platform.

The carriage assembly may further comprise horizontal and vertical axis wheels mounted in pairs at corners of the platform, that form a rolling engagement with the frame rails. The frame rails may comprise inwardly facing guide channels that receive the horizontal and vertical axis wheels so as to maintain longitudinal alignment or the carriage assembly of the frame.

The at least one tension spring may comprise a plurality of coil tension springs that connect the carriage assembly to the foot end of the frame. The machine may further comprise a plurality of posts mounted at laterally-spaced locations across the foot end of the frame, over which attachment loops of the springs are placed. The plurality of tension springs may comprise springs having differing sizes and resistances. The springs may comprise a plurality of larger and smaller springs mounted in alternating relationship.

The adjustable transverse bars may each comprise first and second arms having the bar mounted between upper ends thereof, a pivot connection joining lower ends of the arms to the frame, and means for selectively locking the arms in a plurality of angular positions. The means for locking the arms in a plurality of angular positions may comprise a quadrant plate having a plurality of angled locking slots, and indexing pins mounted to the lower ends of the arms that are received in the angled slots so as to lock the arms in angular position.

The machine may further comprise means for adjusting the longitudinal positions of the first and second transverse bars. The means for adjusting the longitudinal locations of the transverse bars may comprise guide shoes that are mounted to the quadrant plates, and guide channels formed in outboard sides of the frame rails that receive the guide shoes in sliding the engagement therewith. The machine may further comprise means for locking the guide shoes in selected locations along the guide rails. The means for locking the guide shoes in selected locations may comprise spring loaded locking pins that are mounted to the guide shoes, and cooperating openings formed in the guide channels that receive the pins in locking engagement there with.

The machine may further comprise legs mounted to the frame proximate the foot and head ends thereof, that raise the frame and carriage assembly above floor level.

The frame members may be formed of sections of a continuous extrusion. The continuous extrusion may comprise a main guide channel formed in an inboard side thereof that receives the pairs of horizontal and vertical axis wheels of the carriage assembly therein, and a second guide channel in an outboard side thereof that receives the sliding shoes of the adjustable transverse bars therein.

These and other features and advantages of the present invention will be more fully understood from a reading of the following detailed description with reference to the accompanied drawings.

DETAILED DESCRIPTION a. System

Figure 1:
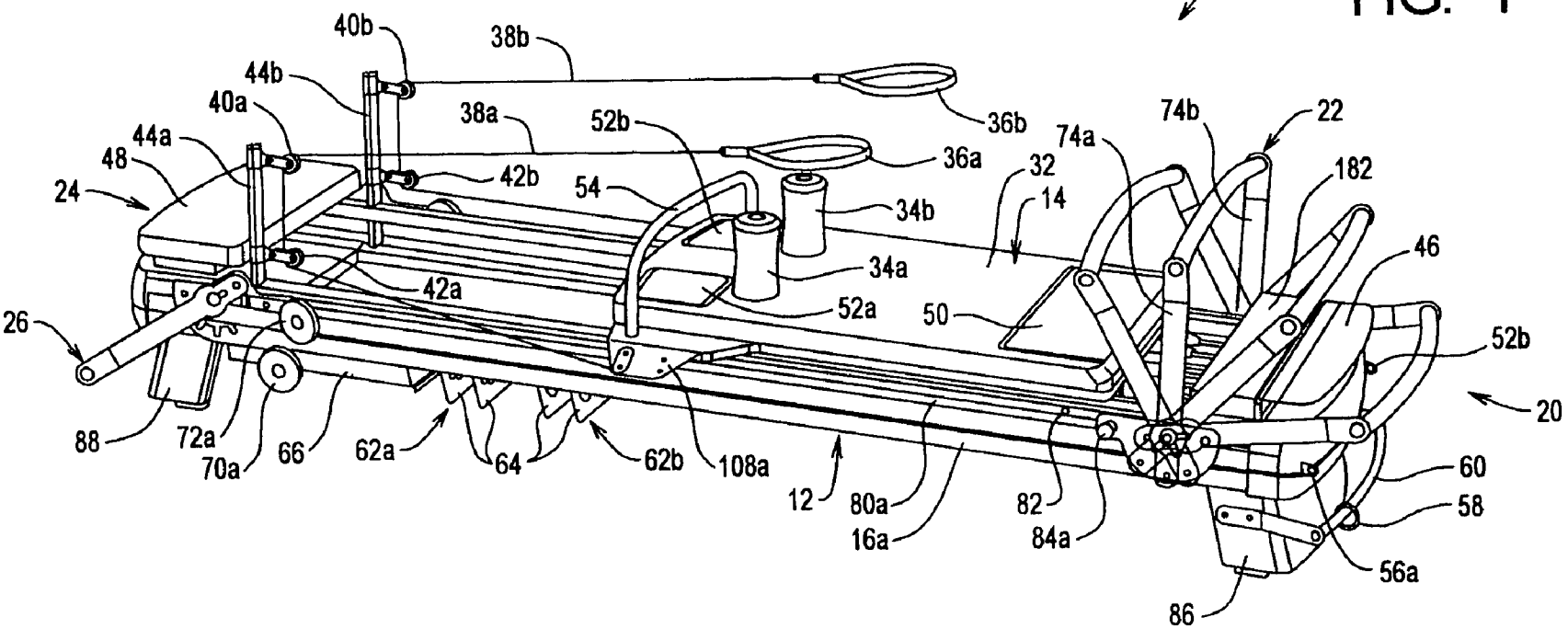
FIG. 1 is a upper perspective view of an exercise machine in accordance with the present invention, showing the manner in which the foot bar thereof is adjustable through a range of angular positions.

FIG. 1 shows an exercise machine 10 in accordance with the present invention. As can be seen, the machine includes a stationary frame assembly 12 and a horizontal, sliding carriage assembly 14. The frame and carriage are somewhat similar in basic configuration to those of a Reformer, so that standard Pilates Method exercises can be performed on the machine of the present invention as well. However, as is described below, the construction and features of the machine of the present invention make it possible to perform numerous additional exercise not possible using conventional Reformer machines, and in addition provide a great many other advantages for both the user and the facility owner/operator.

Figure 2:
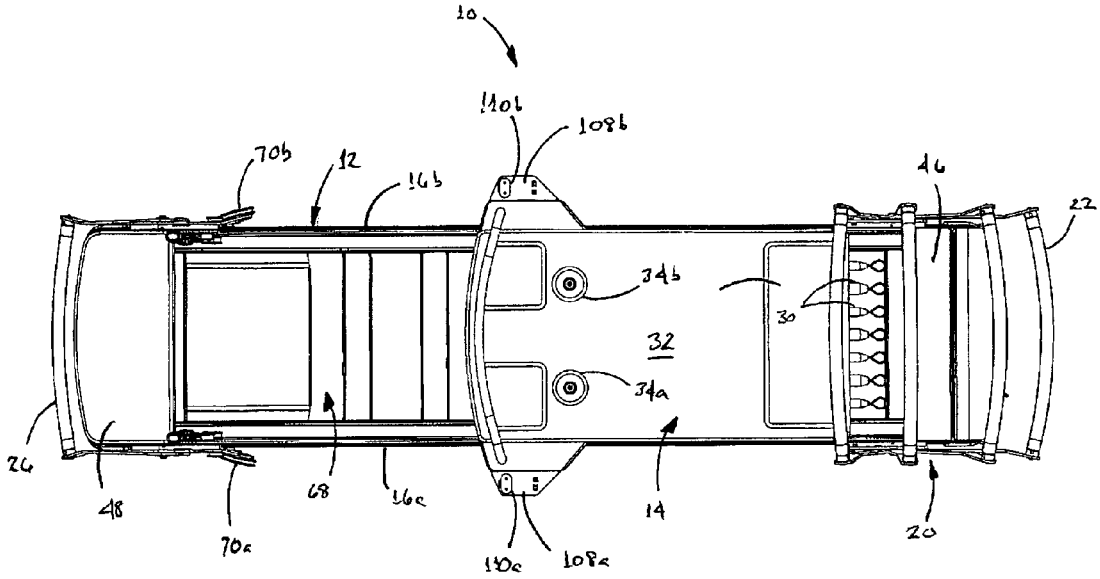
FIG. 2 is a top plan view of the exercise machine of FIG. 1, showing the relationship of the sliding carriage to the stationary frame thereof in greater detail.
Figure 3:
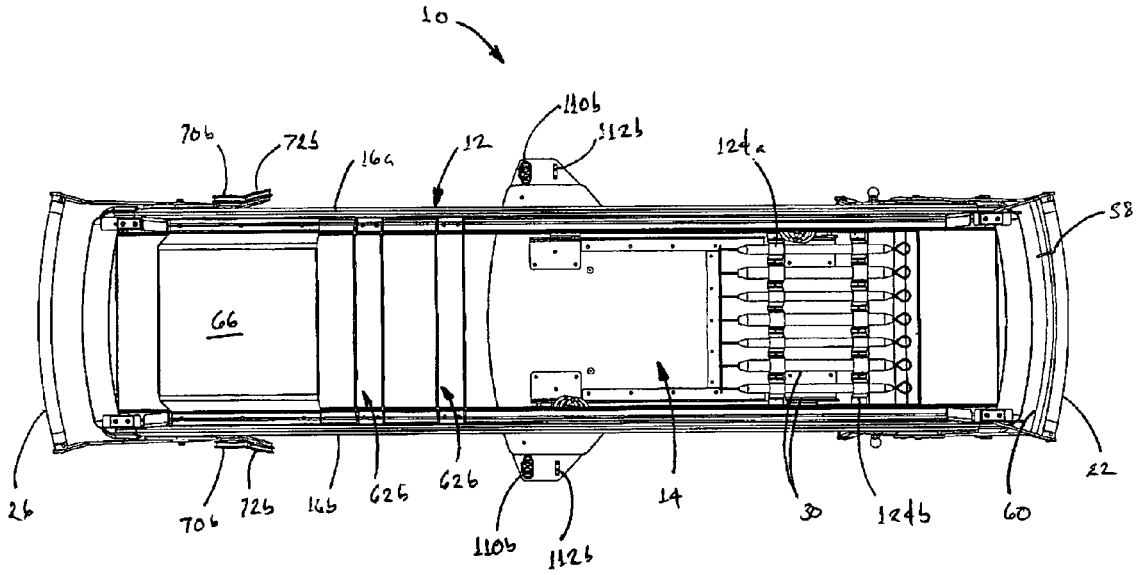
FIG. 3 is a bottom plan view of the exercise machine of FIGS. 1-2, showing the springs that interconnect the frame and sliding carriage in greater detail.

As is shown in FIG. 1, and also in FIGS. 2-3, the frame 12 includes first and second side rails 16*a*, 16*b* that form tracks for longitudinal rolling movement of the carriage assembly 14. As will be described in greater detail below, the side rails are preferably formed of elongate metal (e.g., aluminum) extrusions having the rail tracks formed integrally therein, as well as having features for mounting other components of the frame assembly thereto.

A first end assembly 20 is mounted at the foot end of the frame (i.e., the end of the frame towards which the person's feet are ordinarily directed when reclined on the carriage), and includes an adjustable foot bar mechanism 22; for purposes of illustration, images of the foot bar appear in several angular positions in FIG. 1 and also some of the other figures, however it will be understood that the assembly includes only one foot bar that is adjustable to the multiple positions. A second end assembly 24 is mounted at the opposite, head end of the frame, and includes a hand bar 26; as will be described in greater detail below, the hand bar is pivotable to multiple angular positions, in a manner similar to the foot bar 22. Although bars 22 and 24 are referred to as the foot and head bars, reflecting the manner in which they are used in a majority of exercises, it will be understood that due to the versatility of the machine either bar may be used with the person's hands or feet.

A plurality of tension springs 30 (see FIGS. 2-3) connect the carriage to the end assembly 20, so as to bias the former towards the foot end of the frame and thereby provide a yielding resistance to movement in the opposite direction. Metal coil springs are preferably utilized in the illustrated embodiment, but it will be understood that other forms of springs (e.g., elastomeric members) may be used. The force providing movement of the carriage can be supplied by way of exercising the user's legs, arms, abdomen, and so on. As noted above, some of these exercises can be generally similar to those performed with a conventional Reformer machine: For example, with the user reclined on the main platform 32 of the carriage assembly, the user's legs can push off against the foot bar 22, against the resistance of the springs 30; in so doing, the user's shoulders press against shoulder pillars 34*a*, 34*b*, which are similar to those found on conventional Reformer machines. Also, the user's arms and upper body can be exercised by pulling on hand/arm straps 36*a*, 36*b* (or on corresponding handles) that are mounted to cables 38*a*, 38*b*; the cables that are routed to the head end of the carriage assembly 14, via pulleys 40*a*, 40*b* and 42*a*, 42*b* that are mounted on raised stanchions 44*a*, 44*b* at the head end of the frame, so that pulling on the cables is again resisted by springs 30.

However, the present invention also makes it possible to conduct a great many exercises that differ significantly from the traditional Pilates exercises, in terms of motions, goals and targeted muscle groups. For example, the foot and head end assemblies 20, 24 include step platforms 46, 48, on which the user may place one or both feet. For certain exercises, the user may thus stand with one foot on step platform 46 and the other on the carriage assembly, to exercise by spreading the legs apart against the resistance of the springs 30; alternatively, the user may stand with one foot on the head end foot platform 48 and the other on the carriage, to exercise by drawing the legs together against the resistance of the springs. The user may also perform exercises with both feet on one of the end platforms and hands on the carriage assembly, or vice versa. Still further, the user may place his feet on the carriage and hands on the foot bar 22, to perform exercises by pushing the carriage away from the foot end assembly 20; in the reverse direction, the user may stand on the head end of the carriage and grasp the opposite bar 26 to perform exercises by drawing the feet and hands towards one another.

Non-slip (e.g., rubber) pads 50 and 52*a*, 52*b* are provided at the front and head ends of the main panel of the carriage assembly, to establish frictional engagement with the user's shoes/feet while performing the exercises. Moreover, a low crossbar 54 is mounted across the head end of the carriage, under which the user can hook his feet while pulling against the tension of the springs; the user can also stand on the head end foot platform 48 and grasp the bar 54, in order to pull the carriage assembly towards the head-end of the frame.

The machine 10 includes a number of additional features that enhance its versatility and multiply the number of exercises that can be performed. A pair of spaced-apart, distally projecting eyes 56*a*, 56*b* are mounted at the sides of the foot end assembly 20, to which elastic cords (similar to shock or "bungee" cords) can be hooked to provide resistance when pulled on from a standing or sitting position on either the end platform 46 or the carriage 14. A sliding ring 58 is also provided on a horizontal, transverse bar 60, to which an elastic cord can be attached for performing exercises at various positions or with a side-to-side motion. Barbell racks 62*a*, 62*b*, formed by pairs of depending plates 64, are mounted to the two side rails 16*a*, 16*b* of the frame and include suitably shaped cutouts for receiving and supporting the handles of barbells that can be used in a variety of exercises. A general purpose storage bin 66, formed by a trough-shaped panel, is also mounted to the frame rails for holding an assortment of accessories or articles (e.g., the user's belongings). As can be seen in FIGS. 1-3, the barbell racks and bins are mounted towards the end of the frame, so as to be accessible through an opening 68 that is formed between the carriage and the head end assembly 24 when the former is retracted towards the foot end of the machine by the springs 30.

Additionally, the head end of the machine includes pairs of horizontal—and angled—axis pulleys 70*a*, 70*b* and 72*a*, 72*b*, on opposite sides of the frame, over which the ropes/cables 38*a*, 38*b* may be routed, in place of or in addition to the pulleys on the vertical stanchions 44*a*, 44*b*. For example, the cables may be routed over the angled-axis pulleys 72*a*, 72*b* so that the end straps 36*a*, 36*b* are angled outwardly, in order that the user can exercise with his arms spread wide to the sides of the carriage 14. In another example, the cables can be routed under the horizontal axis pulleys 70*a*, 70*b*, so that the user can pull upwardly against the straps when standing or sitting on the end platform 48. It will be understood that these are only a few examples of exercises than can be performed, and that the combination of pulleys, end platforms, bars and sliding carriage provides a great many other options.

As can be seen with further reference to FIG. 1 that the position of the foot bar is adjustable not just angularly, but in a longitudinal direction as well. The arms 74*a*, 74*b* of the foot bar are pivotally mounted to a pair of guide shoes 78*a*, 78*b* (see FIG. 17) that are in turn received for sliding movement in guide slots or channels 80*a*, 80*b* formed in the frame rails 16*a*, 16*b*. A plurality of holes or bores 82 extend laterally from the guide channels 80*a*, 80*b*, and receive the distal ends of spring-loaded pins in locking engagement therewith. To adjust the longitudinal position of the bar 22, the user therefore simply pulls outwardly on the handles of the pins 84*a*, 84*b* and slides the bar assembly to the desired position, at which point the spring-loaded pins snap into the next set of bores 82 to lock the assembly in place. The longitudinal adjustability of the foot bar not only makes it possible to better accommodate persons having different leg lengths, but also allows the bar to be positioned adjacent to or above the end platform of the carriage, where it can be used in additional exercises (for example, as a hand bar by a person sitting or reclined on the carriage).

A particular benefit of additional exercises that are made possible by the exercise machine of the present invention is the ability to build muscle mass, in addition to the strength, balance and flexibility benefits of the traditional Pilates exercises. In particular, the machine offers the ability to conduct exercises that can be performed in a "to-failure" modality, with the angles and resistances being such that the physical limits of the target muscle groups can be reached within a reasonable, comparatively low number of repetitions. While fundamentally different in nature in from the traditional Pilates method, the "to-failure" approach is provenly effective in developing increased muscle mass and enhancing muscle definition.

Figure 4:
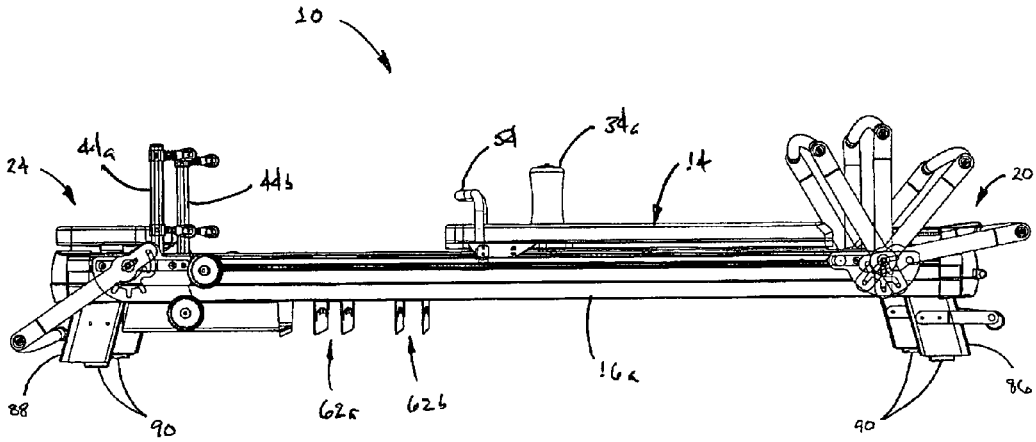
FIG. 4 is a side elevational view of the exercise machine of FIGS. 1-3, showing the relationship of the components thereof in greater detail and again showing the foot bar adjusted to multiple angular positions.
Figure 5:
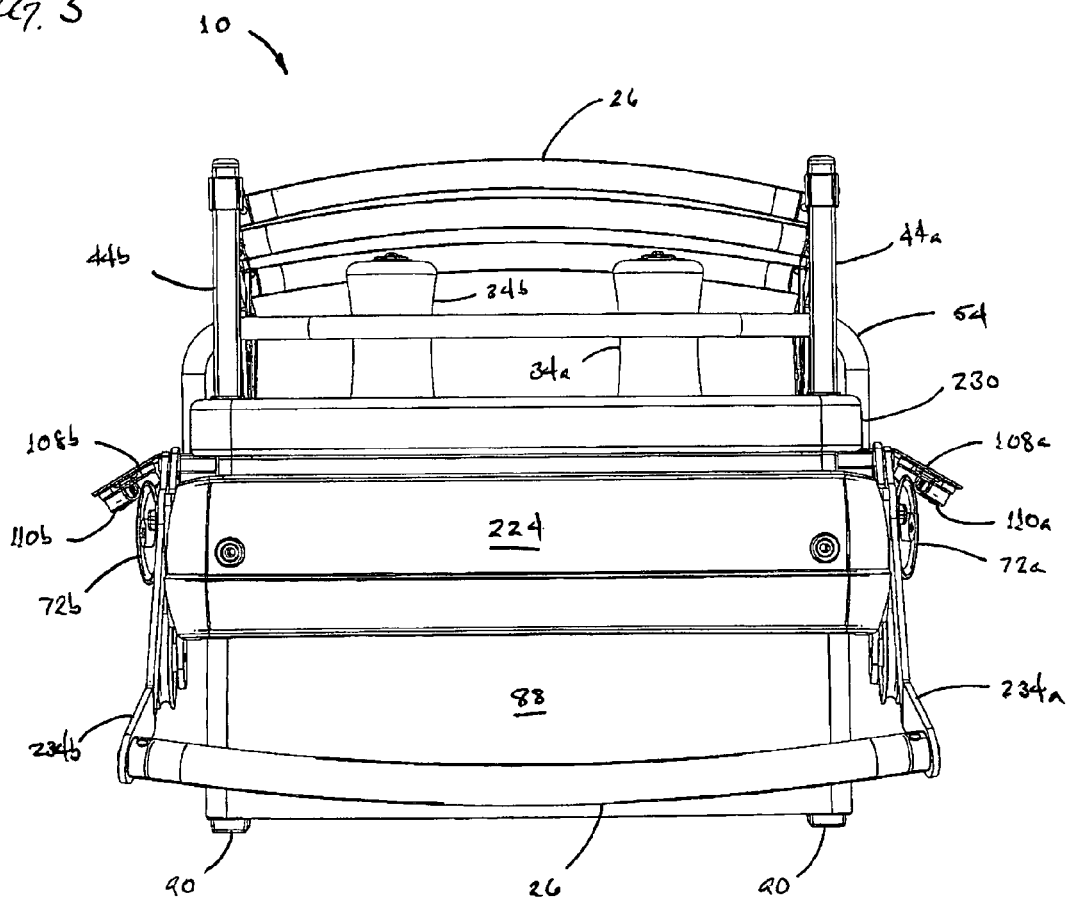
FIG. 5 is a head-end perspective view of the exercise machine of FIGS. 1-4, showing the hand bar assembly of the machine in greater detail.
Figure 6:
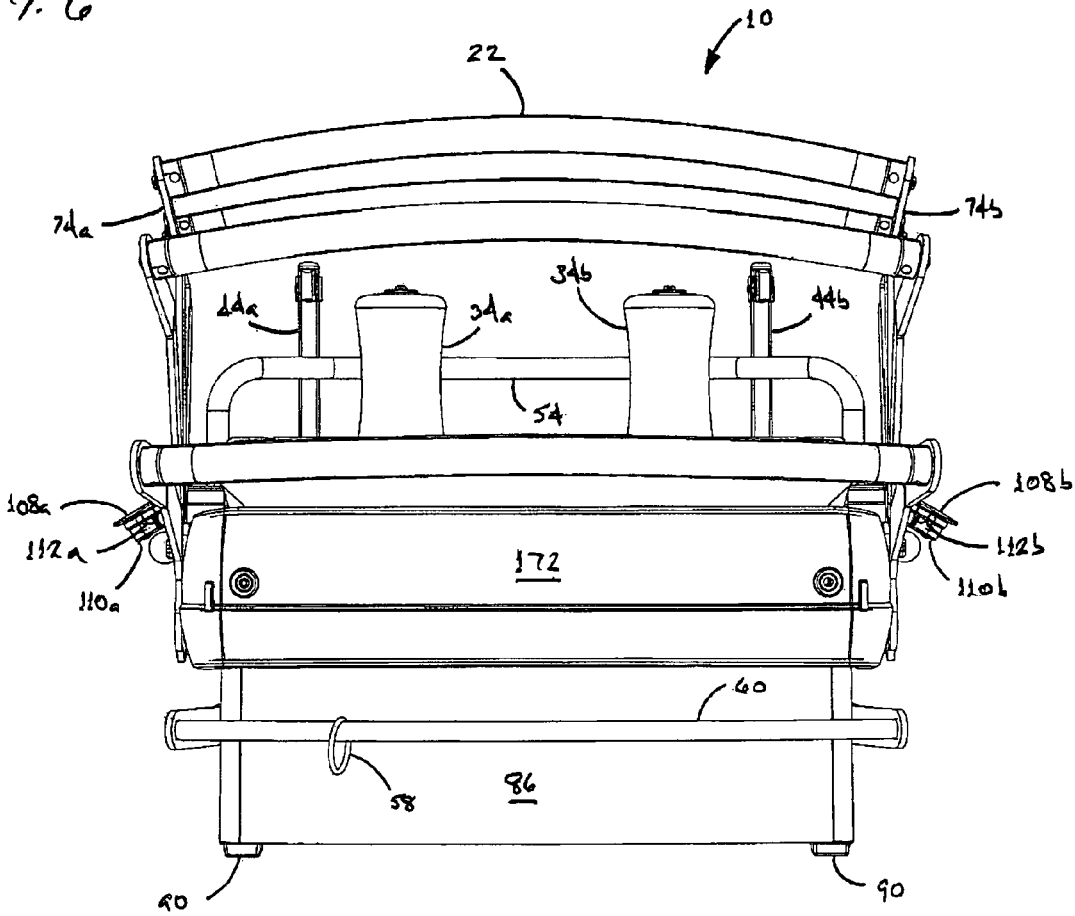
FIG. 6 is a foot-end perspective view of the exercise machine of FIGS. 1-5, showing the configuration of the foot bar in greater detail, and also the cross bar and sliding ring assembly that are mounted at the foot end of the machine, for conducting additional exercises.
Figure 7:
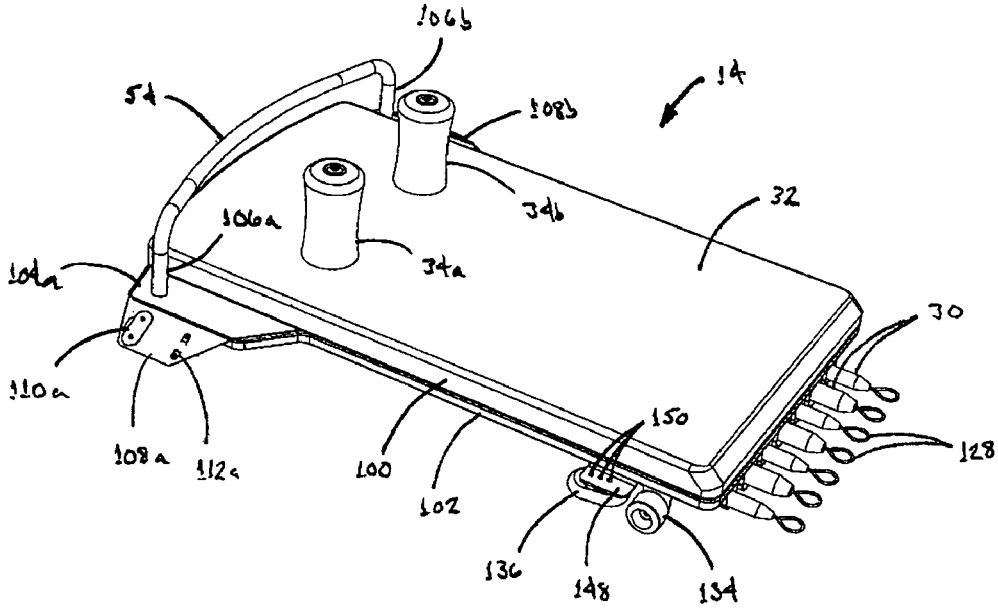
FIG. 7 is an upper perspective view of the carriage assembly of the exercise machine of FIGS. 1-6.

The versatility of the machine, both in terms of the exercises that can be performed and the rack and storage area for additional equipment, largely eliminates the need for additional pieces of the equipment in the exercise studio or other facility. Moreover, the machine is compact, durable and stable, and is comparatively portable so that it can be moved about the facility as desired: As can be seen in FIGS. 4-6, both end assemblies 20, 24 include legs 86, 88 that are angled outwardly towards the ends of the frame and that include non-slip (e.g., rubber) feet 90, which support the carriage and step platforms at a convenient height above the floor and provide space for the underlying storage structures, and also stabilize the machine and prevent it from shifting in a longitudinal direction during use.

b. Carriage Assembly

FIGS. 7-12 show the carriage assembly 14 in greater detail.

Figure 9:
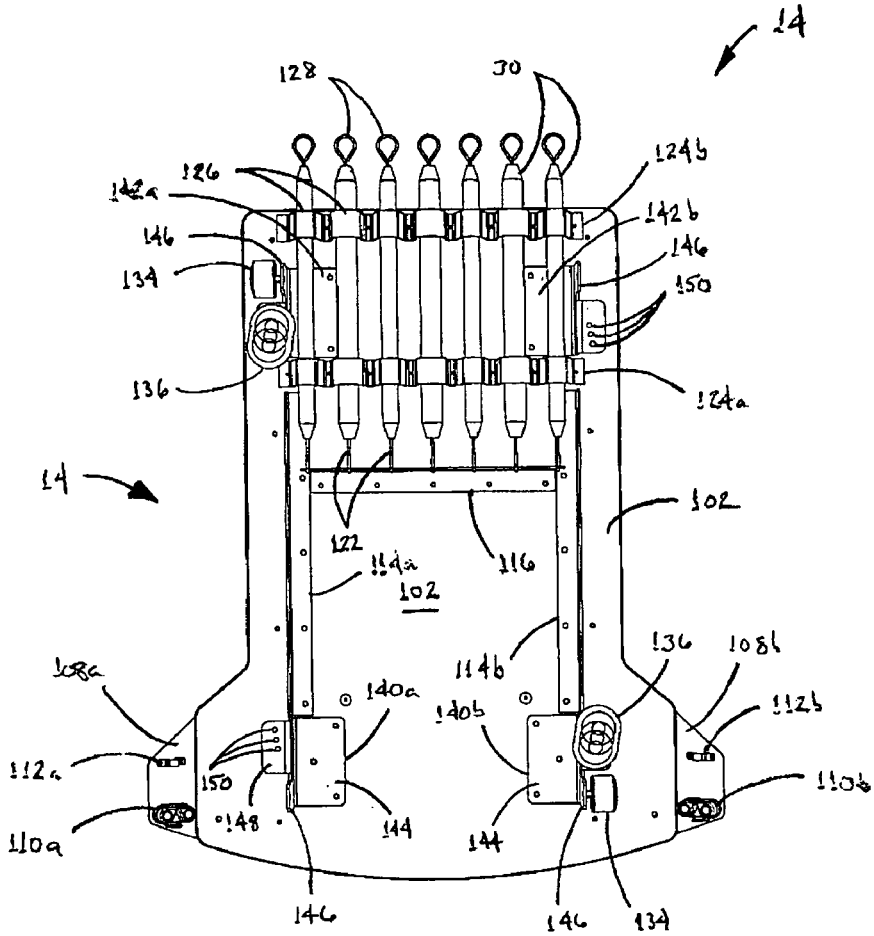
FIG. 9 is a bottom perspective view of the carriage assembly of FIGS. 7-8, showing the configuration of the springs and guide rollers thereof in greater detail.
Figure 10:
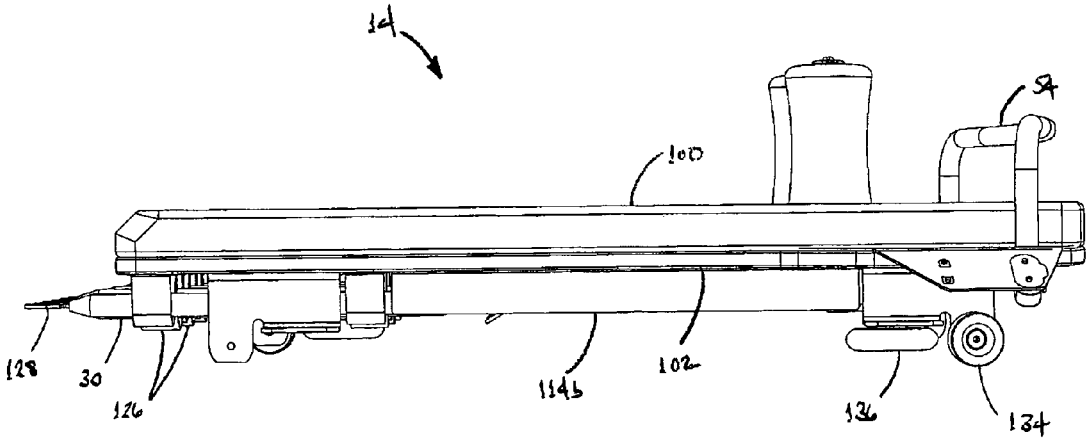
FIG. 10 is a side perspective view of the carriage assembly of FIGS. 7-9.
Figure 11:
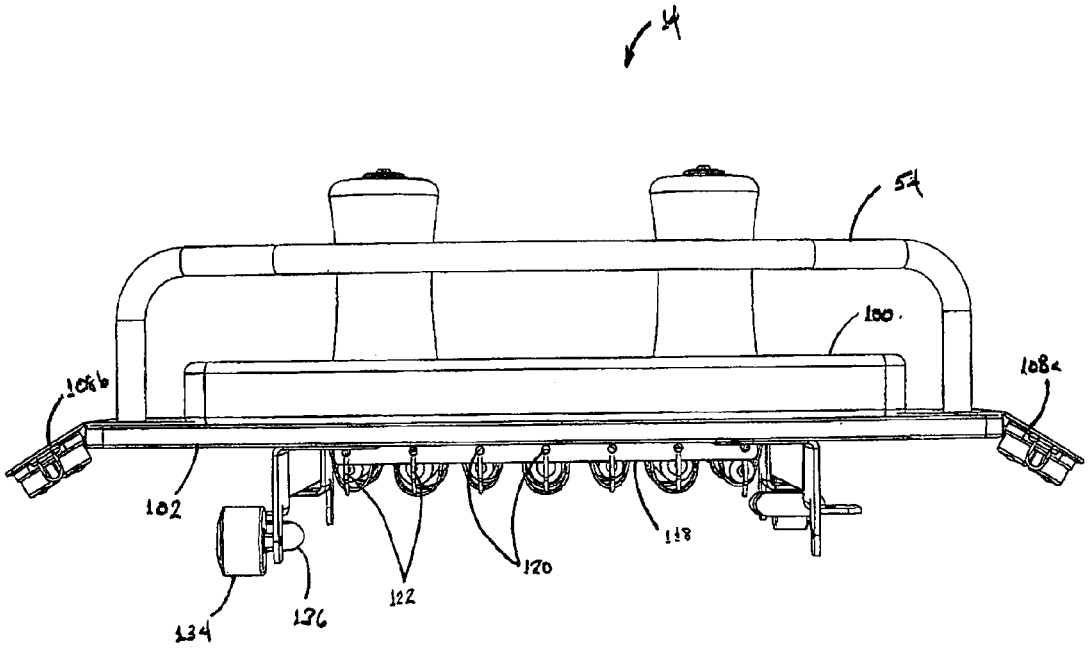
FIG. 11 is a head-end perspective view of the carriage assembly of FIGS. 7-10.
Figure 12:
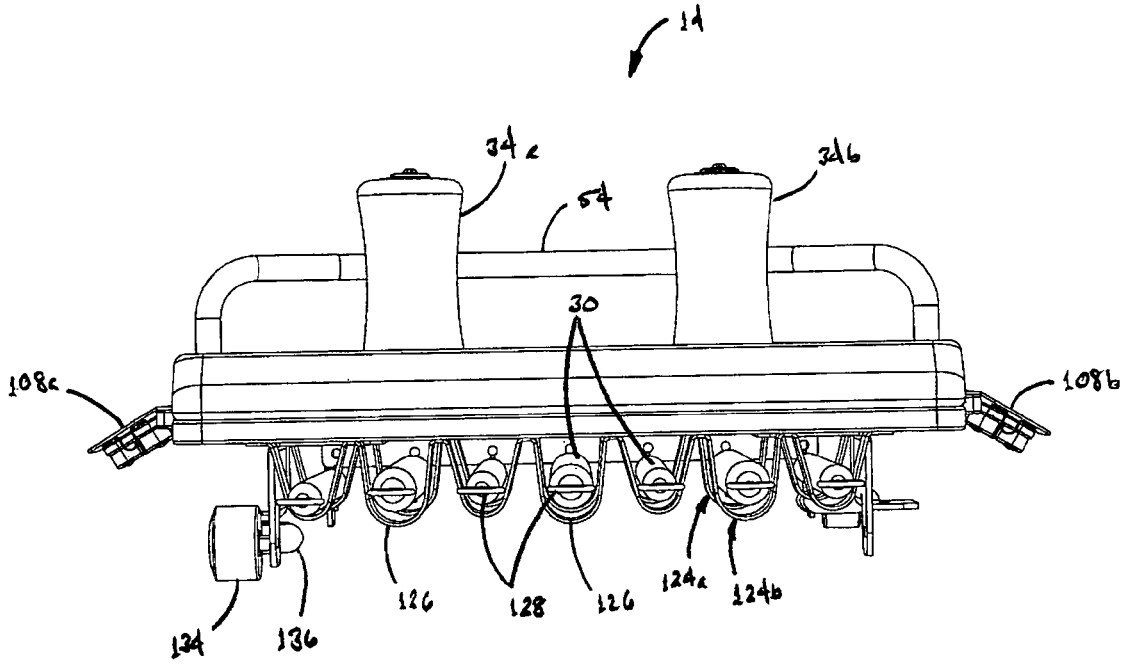
FIG. 12 is a foot-end perspective view of the carriage assembly of FIGS. 7-11.
Figure 13:
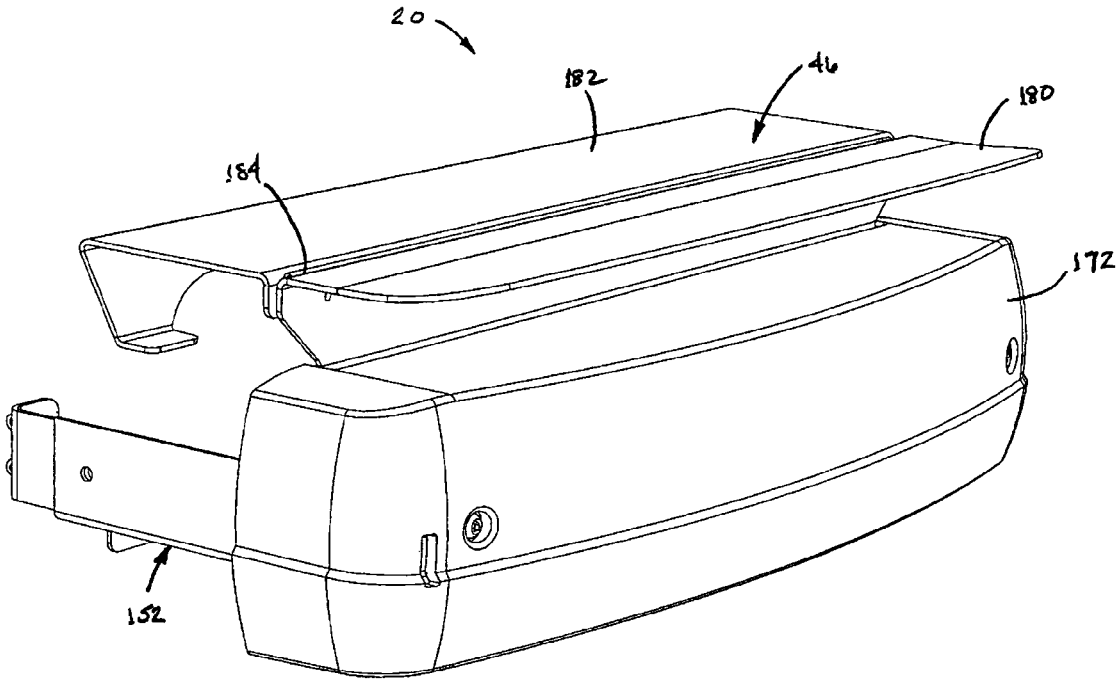
FIG. 13 is an upper perspective view of the end cover and step assembly of the foot and of the stationary frame of the exercise machine of FIGS. 1-6.
Figure 14:
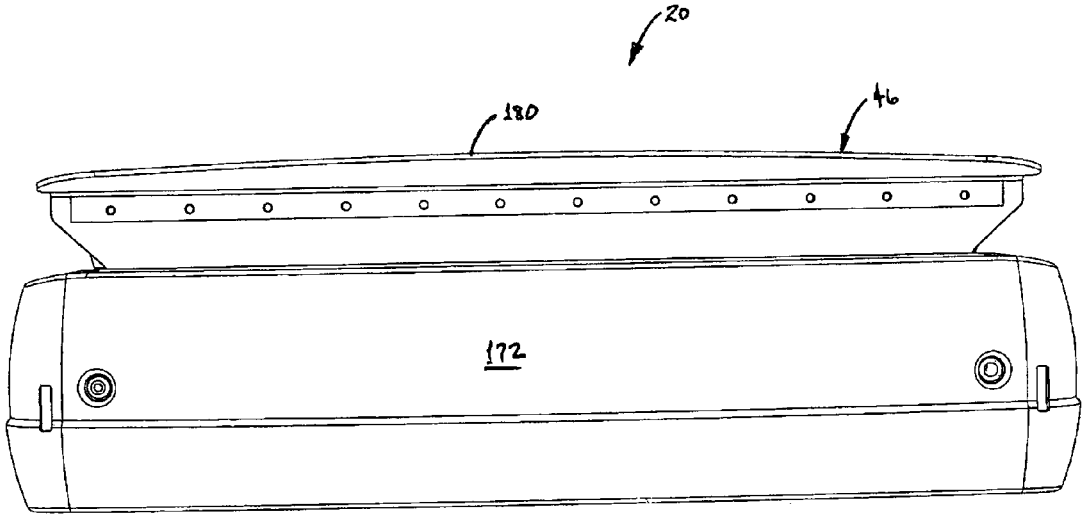
FIG. 14 is a second perspective view of the cover and step assembly of FIG. 13.

As can be seen, the main platform 32 of the carriage has a generally rectangular configuration, with a padded upper layer 100 that is mounted atop a rigid, structural panel 102. The head end of the structural panel includes laterally-extending wing portions 104*a*, 104*b*, to which the vertical ends 106*a*, 106*b* of the crossbar 54 are mounted, and first and second downwardly angled flanges 108*a*, 108*b*, to which the ends of the ropes 38*a*, 38*b* connect. As can be seen in FIG. 9, each of the flanges 108*a*, 108*b* includes rope attachment fittings mounted on its lower side, namely cam cleats 110*a*, 110*b* and trailing fairleads 112*a*, 112*b*. The ropes 38*a*, 38*b* can thus be shortened by simply pulling on the free ends (i.e., the ends running behind the fairleads 112*a*, 112*b*), or lengthened by simply pulling the forward runs of the ropes downwardly to free them from the cleats and then slacking the ropes and pulling them back through the cleats to the desired length. Moreover, the downward angle of the flanges 108*a*, 108*b* and the locations of the cam cleats and fair leads on the lower sides of the flanges keep these structures out of the way of the user's arms when exercising in a reclined position on the platform.

Figure 8:
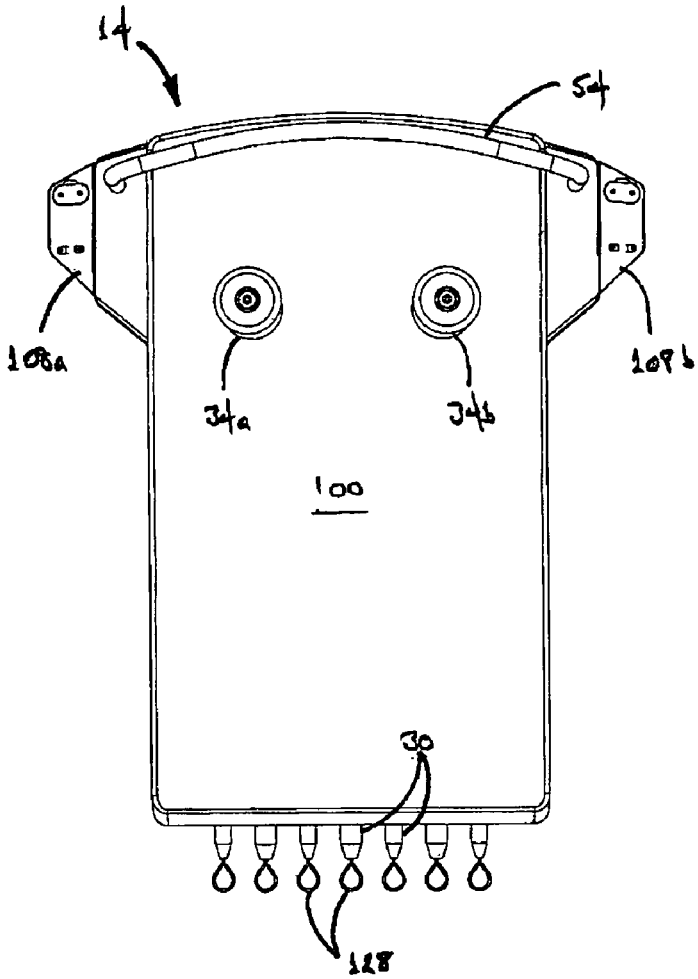
FIG. 8 is a top perspective view of the carriage assembly of FIG. 7, showing the configuration of the platform and transverse bar of the carriage assembly in greater detail.

As can be seen with further reference to FIG. 9, first and second longitudinal side rails 114*a*, 114*b*, suitably formed of metal angle stock, are mounted to the lower side of the platform 32, with a third rail 116 being mounted transversely between the two longitudinal rails so as to span the bottom of the platform; the depending flange portion 118 of the transverse rail (see FIG. 11) is provided with a series of holes 120 that provide attachment points for the loops 122 at the forward ends of the tension springs 30. Transverse retaining bands 124*a*, 124*b* are mounted at spaced locations rearwardly of the bracket 116, and include a series of downwardly bent channel portions 126 that receive and support the bodies of the springs beneath the underside of the platform. As can be seen in FIGS. 8 and 9, the springs 30 are preferably arranged in alternating, larger and smaller sizes, with the channel portions 126 of the retaining bands being sized accordingly so as to support and maintain the springs in longitudinal alignment without interfering with the action of springs as they extend and retract.

The loops 128 at the rearward ends of the springs, in turn, connect to pegs 130 (see FIG. 15) on the foot end assembly 20. The loops are attached by placing them over the pegs, and are retained against slipping off by enlarged head portions 132 on the upper ends of the pegs. Attachment/detachment of the springs is therefore a simple matter, only requiring the user to pull slightly on the end of the spring and lift the loop onto or off of the corresponding peg.

The resistance of the platform is therefore readily adjusted by reducing or increasing the number of springs that are attached. Moreover, the combination of larger and smaller sizes of springs offers a great range of adjustability, by using the different sizes of springs in various combinations; in the preferred embodiment that is illustrated, there are three of the larger springs (which offer greater resistance) and four of the smaller, mounted in alternating relationship; this allows the user to adjust the resistance of the platform without causing excessive off-center, torsional loading of the platform, by simply attaching/detaching the springs evenly on the two sides of the longitudinal centerline. It will be understood, however, that other combinations and configurations of springs may be used.

The cart assembly further includes horizontal-axis wheels 134 and vertical-axis wheels 136, arranged in pairs at each of the four corners of the platform. In FIGS. 7-12, the vertical-axis wheels 136 are shown in multiple positions to illustrate their adjustability, however, it will be understood that in actuality there is only one vertical-axis wheel at each corner; moreover, alternating corners are shown without the wheels attached, for ease of illustrating the associated mounting structures. The latter include mounting brackets 140*a*, 140*b* at the head end of the platform, and 142*a*, 142*b* at the foot end. The brackets are identical in configuration, each including a base portion 144 that mounts to the bottom of the platform panel 102 (e.g., using screws), a depending vertical flange portion 146 to which the axle of the horizontal-axis wheel 134 is mounted, and a horizontal flange portion 148 to which the axle of the vertical axis wheel is mounted. As can be seen in FIG. 9, the horizontal flange portion 148 to which the axle of the vertical-axis wheel is mounted includes a plurality of holes arranged in a row that is angled outwardly from the longitudinal centerline of the carriage assembly, which permits the vertical-axis wheels 136 to be mounted in multiple positions as shown; this feature allows the transverse span between the vertical-axis wheels to be adjusted, so that they bear against the side rails of the main frame 12 (as will be describe in greater detail below) to align the carriage and maintain its longitudinal orientation during use. The horizontal-axis wheels, in turn, support the carriage for longitudinal rolling movement on the rails of the frame, as will also be described below.

c. End Covers and Step Platforms

FIGS. 13-22 show the end assemblies 20, 22 and their associated adjustable bars 22, 26 in greater detail.

Figure 15:
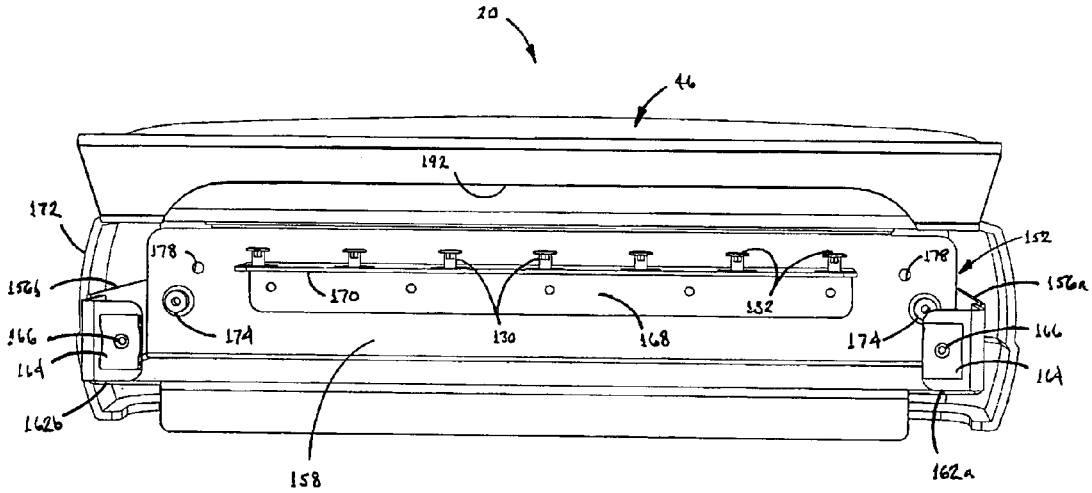
FIG. 15 is an end elevational view of the cover and step assembly of FIGS. 13-14, showing the connections for the springs that join the stationary frame to the moving carriage assembly.
Figure 16:
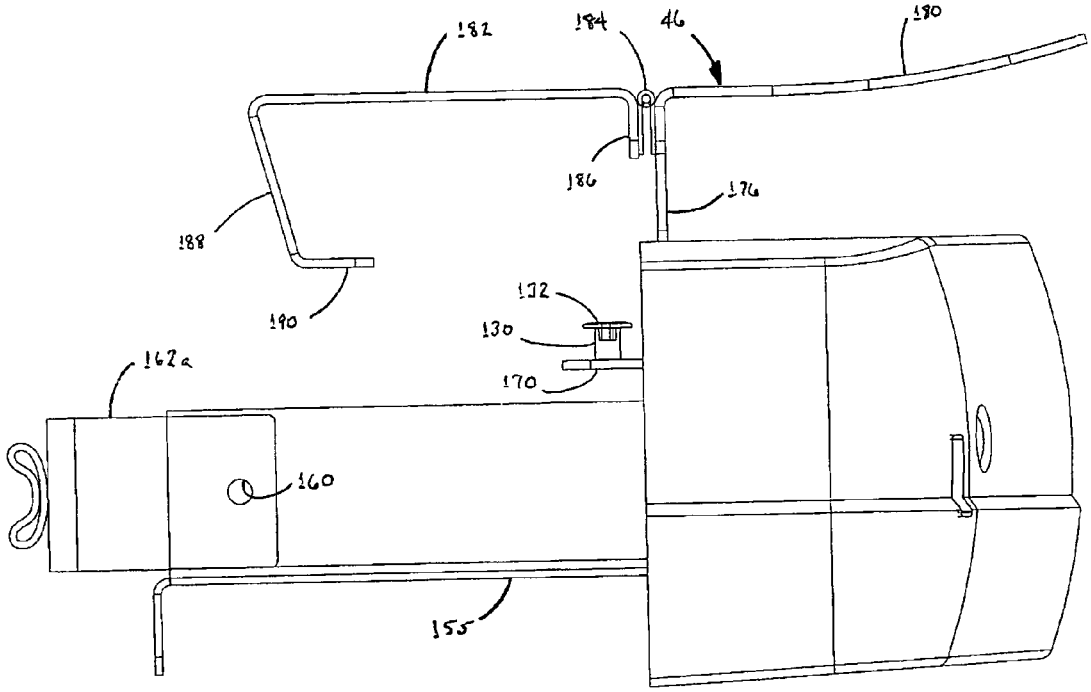
FIG. 16 is a side elevational view of the cover and step assembly of FIGS. 13-15, showing the components thereof in greater detail.

As can be seen, each of the end assemblies is constructed on a subframe 152, 154, that fits within in and bolts to the corresponding ends of the rails 16*a*, 16*b* of the main frame 12. As can be seen in FIGS. 15-16, the subframe 152 of the foot end assembly 20 includes a horizontal base panel 155 having upward edges that form first and second longitudinal side walls 156*a*, 156*b*, that extend forwardly from a transverse back plate 158. The side walls include transverse holes 160 (see FIG. 16), through which bolts (not shown) pass in order to mount the side walls to threaded plates that are received in the main frame rails 16*a*, 16*b* (as will be described below), thus securing the end assembly to the main frame. First and second stop members 162*a*, 162*b* are mounted to the distal ends of the walls 156*a*, 156*b*, to react against the depending flange portions 146 of the rearward wheel assemblies in order to arrest motion of the carriage towards the foot end of the assembly. Cushion members 164, suitably formed of a short piece of resilient (e.g., rubber) hose attached to the stops by bolts 166 or other fasteners, serve to cushion the impact with the carriage.

An angle bracket 168 mounted to the face of the back plate 158 provides a horizontal, forwardly-projecting flange portion 170 upon which the spring attachment pins 130 are mounted. This and the other pieces of the subframe are suitably formed of heavy gauge, bent and/or welded sheet steel or similar material.

For reasons of both aesthetics and safety (e.g., to prevent users from accidentally kicking their legs/feet against the metal pieces of the subframe), an end cover 172 is mounted over the rearward side of the end frame, by bolts (not shown) threaded into sockets 174 in the end plate 158. The end cover is suitably formed of molded plastic or similar material.

The step platform 46 is also mounted to the subframe, by a depending panel 176 that is mounted to the back panel 158 of the frame, suitably by bolts (not shown) that pass through holes 178 in the back panel and cooperating openings in the panel 176.

As can be seen in FIG. 16, the foot-end step platform 46 of the preferred embodiment has a two-piece construction. The rearward section 180 (i.e., the portion towards the foot end of the machine) is formed by an extension of the mounting panel 176, bent approximately 90° so that it first extends horizontally and then curves upwardly towards its distal edge; the gently concave surface then is thus formed provides an enhanced platform for the user's feet for certain exercises, especially for the toes of the user's shoes when leaning over and pushing against the carriage assembly.

The forward section 182 of the platform provides a horizontal footing surface that is generally level with the horizontal portion of the rearward platform section 180. However, rather than being fixed, the forward platform section 182 is joined to the rearward section by a hinge 184, that is mounted to the stationary panel 176 and a depending lip 186 of the forward section 182.

When in the horizontal orientation that is shown in FIG. 16, the forward platform section 182 extends over and covers the pins 130 and the associated attachment loops of the springs. A downwardly-extending front panel 188 and rearwardly-extending lip 190 combine to provide a more complete enclosure for the spring ends, and also form a partial box cross-section to provide the forward section of the platform with added rigidity. In order to access the spring ends (e.g., to attach or detach selected springs as described above), the user simply lifts a forward edge of the hinged platform section 182 and flips it back, to expose the springs and the attachment pins 130; as can be seen in FIG. 15, the front of the pivoting platform section is provided with a cutaway edge 192 under which the user's fingers can be slipped, in order to facilitate opening of the cover. Once the desired springs have been attached/detached, the hinged section is pivoted back down to the horizontal orientation, thus establishing a substantially continuous upper surface for the foot platform.

Figure 17:
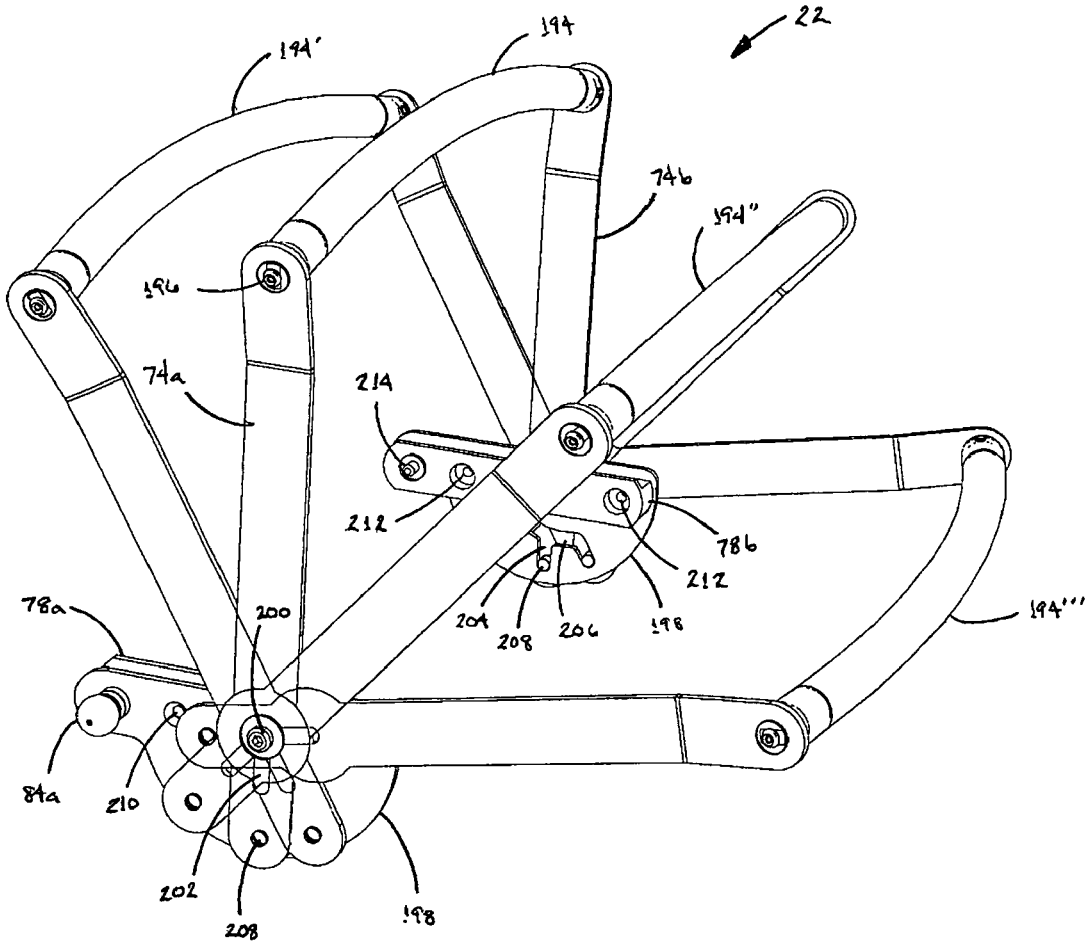
FIG. 17 is a perspective, multi-position view of the foot bar assembly of the exercise machine of FIGS. 1-6, showing the mechanism thereof in greater detail.
Figure 18:
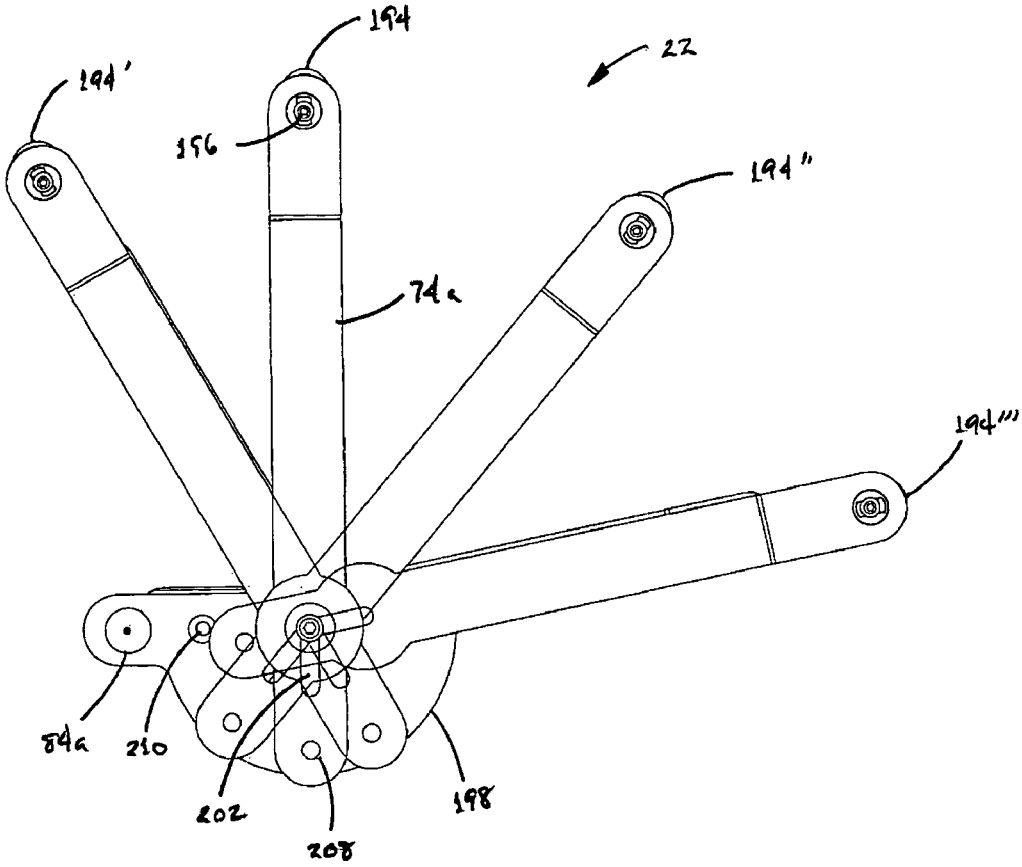
FIG. 18 is a side perspective view of the foot bar assembly of FIG. 17, showing the relationship of the components in the different angular positions of the foot bar.

FIGS. 17-18 show the adjustable bar 22 of the foot end assembly in greater detail. Again, it will be understood that the figures show one bar, in four angular positions to which it can be adjusted.

As can be seen, the transverse bar 194 is preferably bowed upwardly (convexly) and padded, and is mounted by bolts 196 to the upper ends of the arms 74*a*, 74*b*. The lower ends of the arms are pivotally mounted to quadrant plates 198 by bolts 200. The shanks of the bolts are received in elongate slots 202 formed in the arms, that allow the arms to be slid up-and-down relative to the bolts and quadrant plates. The quadrant plates 198, in turn, include a plurality of angled, downwardly-extending slots 204 that are interconnected by an arcuate connecting slot 206. Indexing pins 208 are mounted to the lower ends of the two arms, below the pivot bolts 200, and protrude inwardly so that they are received in the slots in the quadrant plates.

In order to adjust the angle, the user thus simply lifts the bar, so that it slides upwardly and raises the indexing pins out of the downwardly angled slots 204. The user then pivots the bar to the desired angle and pushes it back down, so that the pins enter and engage the correspondingly angled set of slots in the quadrant plate. Accordingly, in addition to the vertical position, FIG. 17 shows the bar in a forwardly-angled position 194', a rearwardly-angled position 194", and a horizontal position 194'''. It will be understood that other angles may be provided, and that other forms of angulation and locking mechanisms may be used in some embodiments.

The quadrant plates 198 are mounted to the guide shoes 78*a*, 78*b* by bolts (not shown) that pass through openings 210 in the plates and are threaded into openings 212 in the shoes. As described above, the shoes are received for sliding movement in cooperating slots in the rails 16*a*, 16*b* of the main frame 12, so that the position of the bar assembly is adjustable in a longitudinal direction. Pin ends 214 protrude inwardly from the guide shoes to engage the openings 82 in the frame rails (see FIG. 1), and are withdrawn from the openings to unlock the shoes, by pulling outwardly on the spring loaded knobs 84*a*, 84*b*.

Figure 19:
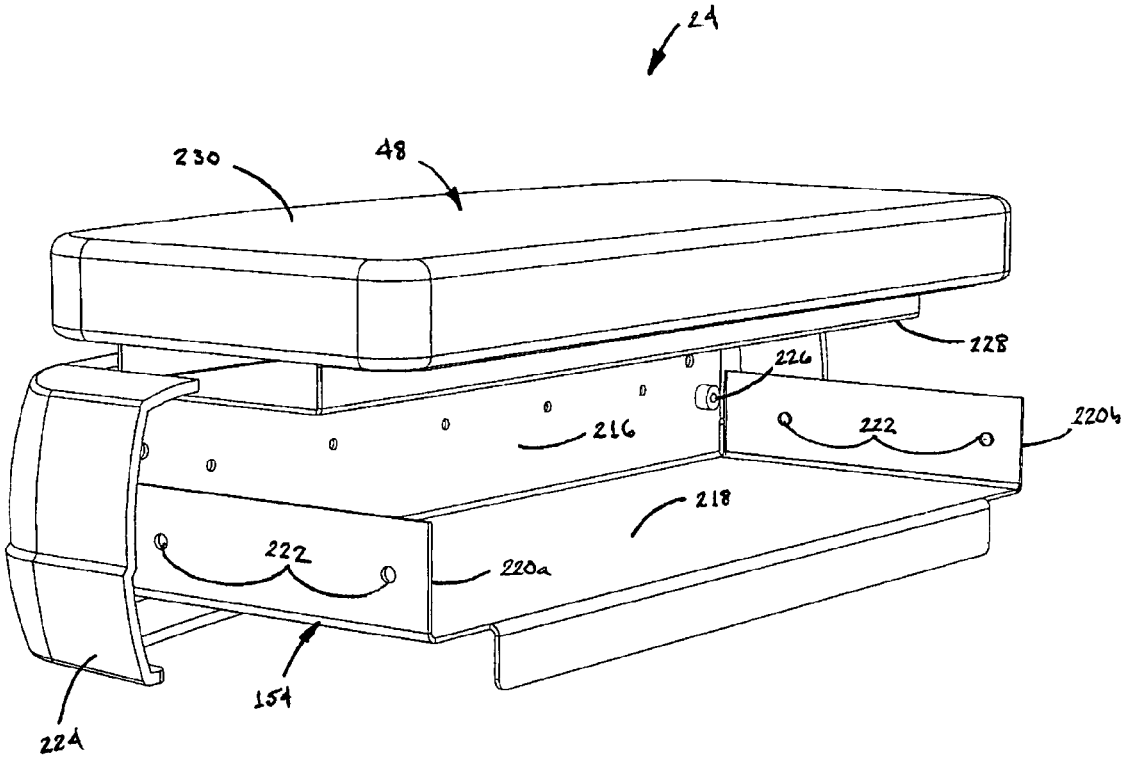
FIG. 19 is an upper perspective view of the cover and step assembly of the head end of the stationary frame of the exercise machine of FIGS. 1-6.

As can be seen in FIG. 19, the construction of the head end assembly 24 is generally similar to the foot end assembly, in that this includes a transverse, vertically extending back panel 216, and a horizontal base panel 218 having up-turned edges that form vertical side walls 220*a*, 220*b* that project longitudinally from the back panel. As with the corresponding side walls of the foot end assembly, the side walls 220*a*, 220*b* include holes 222 through which bolts (not shown) pass in order to attach them to threaded plates received in the frame rails 16*a*, 16*b*. Similarly, the outwardly-facing side of the subframe is enclosed by a cover 224 that is mounted to the former by bolts (not shown) received in threaded bores 226.

Figure 20:
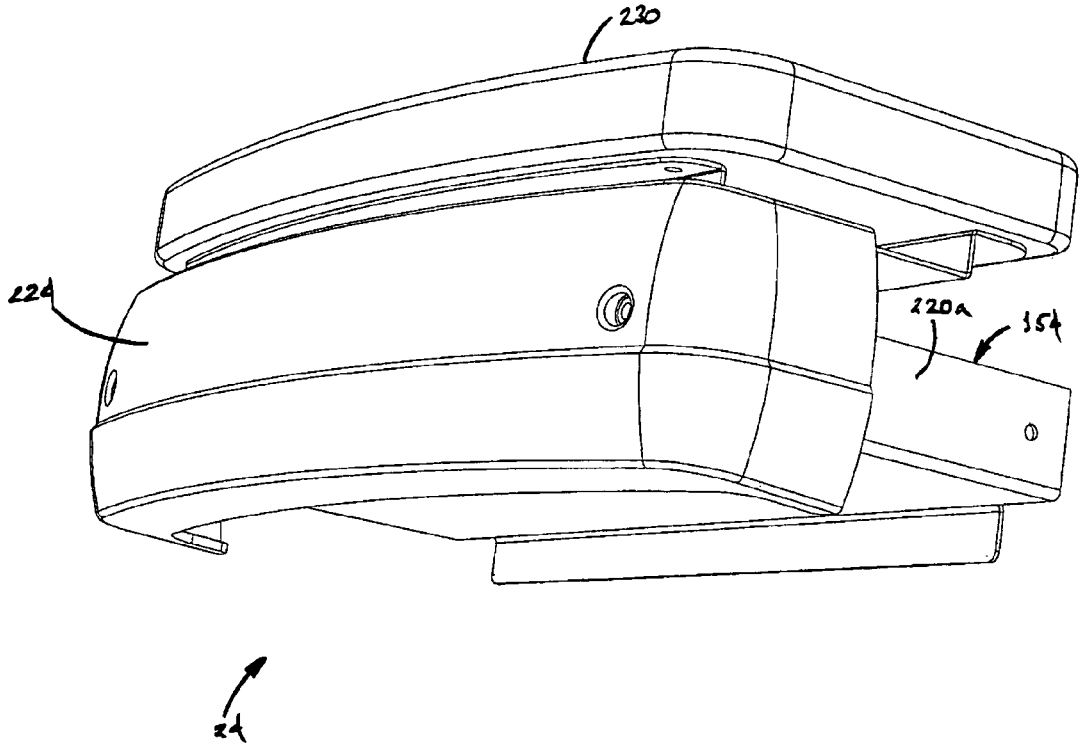
FIG. 20 is a bottom perspective view of the cover and platform assembly of FIG. 19, showing the components thereof in greater detail.

The structure of the foot platform 48 is somewhat simplified as compared with its counterpart at the opposite end of the machine, being stationarily supported by a channel and flanges 228 fixedly mounted (e.g., bolted or welded) to the back plate 216 of the subframe. However, the upper surface is preferably provided with a cushioning pad 230, as shown in FIGS. 19-20, to enhance user comfort while performing exercises seated thereon (e.g., pulling the hand straps 36*a*, 36*b*).

Figure 21:
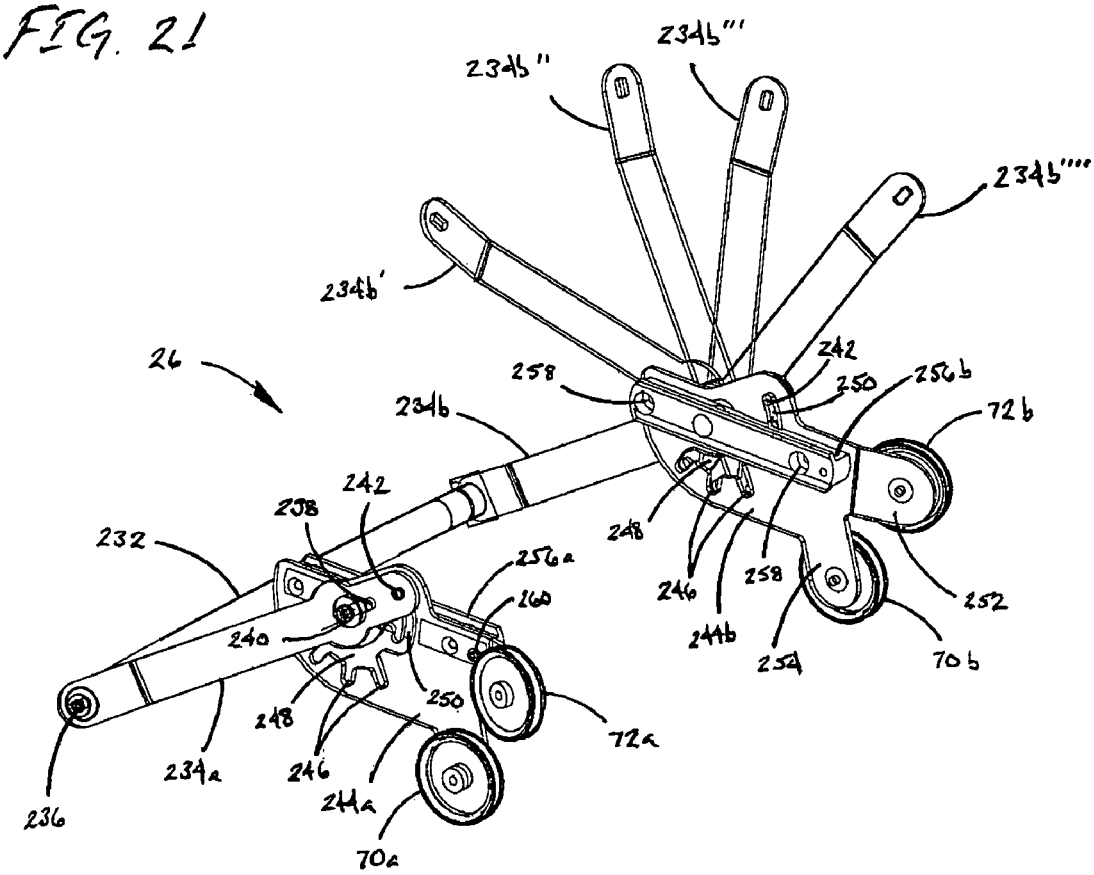
FIG. 21 is an upper perspective view of the hand bar assembly of the exercise machine of FIGS. 1-6, showing the manner in which the hand bar is adjusted to multiple angular positions.
Figure 22:
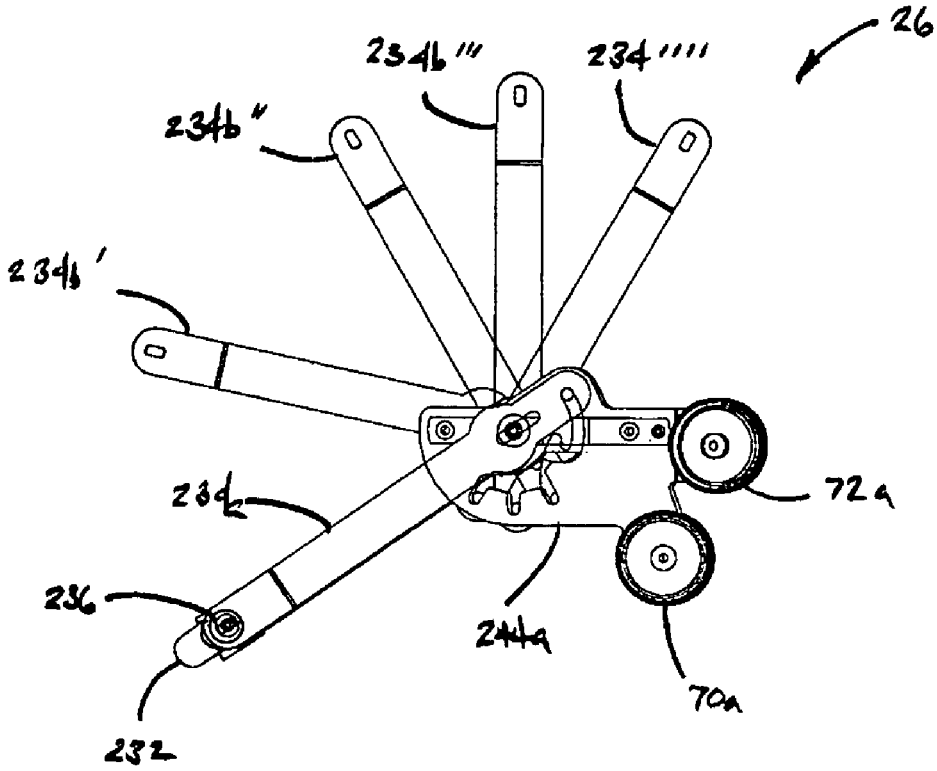
FIG. 22 is a second perspective view of the hand bar assembly of FIG. 21, showing the relationship of the components in the multiple angular positions in greater detail.

The head-end bar assembly 26 is likewise similar in its overall operation to its foot-end counterpart. As can be seen in FIGS. 21-22, the transverse, convexly bowed bar 232 is again supported on two arms 234*a*, 234*b*, being mounted to the outer ends thereof by bolts 236. The lower ends of the arms have slot openings 238 through which the shanks of the pivot bolts 240 pass, and indexing pins 242 that are received in the cooperating slots of quadrant plates 244*a*, 244*b*. The angled and connecting slots 246, 248 in the quadrant plates are similar to those described above, and act to lock the arm in a plurality of selected angular positions, as indicated at 234*b*', 234*b*", 234*b*''' and 234*b*''''. In this case, however, there is an additional arcuate slot 250 that communicates with, and forms an extension of, the main connecting slot 248, that allows the bar to be fully depressed (i.e., to a position near the floor), so as to move it out of the way of a user when performing exercises seated on platform 248. As can be seen, the extension slots can be entered by raising the bar slightly from the horizontal position (in which the indexing pins are located in the upper ends of connecting slots 248), and then pushing rearwardly so that the pins pass under a dog-leg proximate the ends of the connecting slots and thereby move into the extension slots.

As can be seen with further reference to FIGS. 21-22, the quadrant plates of the head end assembly each include upper and lower flange, or ear-shaped extensions 252, 254. The upper extensions are angled outwardly, with the upper, angled pulleys 72*a*, 72*b* being mounted thereto, while the lower extensions lie in the same plane as the main plate and carry the lower pulleys 70*a*, 70*b* parallel to the side rails of the frame. The upper and lower sets of pulleys are thus aligned to direct the ropes during the use of the machine, as described above.

Also similar to the other bar assembly, guide shoes 256 are mounted the inboard sides of the quadrant plates, by bolts that are received in threaded openings 258. As described previously, the guide shoes are received in cooperating slots in the outer sides of the main frame rails 16*a*, 16*b*, and are locked in place by pins 260 that engage cooperating openings in the rails.

d. Frame Rails

Figure 23:
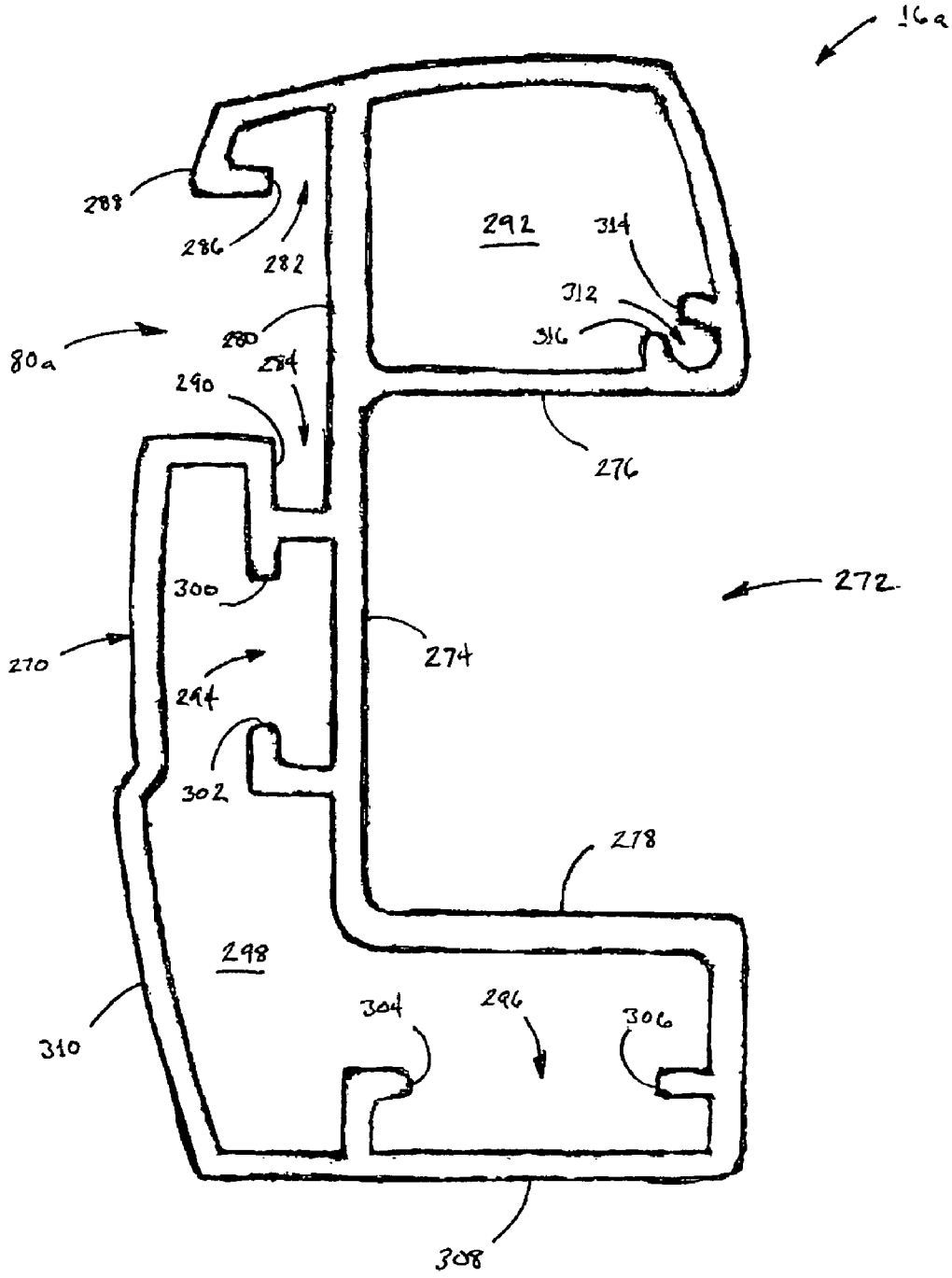
FIG. 23 is a cross-sectional view of one of the extruded side rails of the frame of the exercise machine of FIGS. 1-6, which form the tracks for the moving carriage assembly and to which other components of the machine are mounted.

FIG. 23 provides a cross section of frame rail 16*a*, the other frame rail 16*b* being of identical construction.

As can be seen, the frame rail is formed of a tubular extrusion 270, suitably extruded aluminum alloy. The cross-section is generally elongate in the vertical dimension, providing the rails with rigidity and resistance to bending when subjected to vertical loading, due to the weight of the user on the carriage assembly.

A primary guide channel 272 is formed on the inboard side of the rail extrusion, being defined by a recessed vertical wall 274 and upper and lower horizontal walls 276, 278. The vertical gap between the upper and lower walls is sized to receive the horizontal-axis wheels of the carriage assembly, with the rolling surfaces of the wheels resting on the lower wall 278. The vertical-axis wheels, in turn, ride against the vertical walls 274, so as to maintain alignment of the carriage assembly between the two side rails of the frame. It will therefore be understood that thickness of the vertical-axis wheels, lies within the height of the horizontal-axis wheels so that both can be received in the single guide channel 272.

Guide channel 80*a* is in turn formed in the outboard side of the extrusion, proximate the upper edge thereof. As described above, the outer guide channel receives the sliding shoes 78*a*,

78*b*, and 256*a*, 256*b* to which the adjustable bars are mounted. The guide channel 80*a* therefore includes an inner vertical wall 280 against which the shoe slides, and upper and lower secondary channels 282, 284 that capture the upper and lower edges of the shoe so as to retain it within the main channel 80*a*. As can be seen, the upper secondary channel is defined by a gap between the inner wall 280 and a depending, inwardly directed lip 286 on an upper flange 288 of the extrusion, while the lower secondary channel is defined by a gap between the inner wall 280 and a second, outwardly spaced vertical wall 290. In addition, the locking holes 82 are formed through the inner vertical wall 280, between the guide channel 80*a* and an interior cavity 292 of the extrusion, for receiving the locking pins of the sliding bar assemblies as described above.

The extrusion 270 also includes internal guide slots 294, 296, formed within a second cavity 298 in a lower portion of the rail. The channels 294, 296 are semi enclosed, with side walls having inwardly projecting lips 300, 302 and 304, 306. Each is configured to receive a screw plate (not shown) having threaded bores, the upper channel 294 being aligned vertically (i.e., to hold the screw plate on edge) and the lower channel 296 being aligned horizontally (i.e., to hold the screw plate flat); the screw plates are preferably formed of steel or other relatively hard metal, so as to provide threads that are more resistant to stripping than aluminum. The threaded bores in the upper screw plate align with corresponding bores (not shown) in the vertical walls 274 of the main guide channel, to receive the mounting bolts of the end subframes 152, 154 as described above. The lower screw plates, in horizontal channels 296, align in turn with openings in the horizontal bottom wall 308 of the extrusion, to receive bolts (not shown) that attach the legs 86, 88 to the ends of the frame.

The steel screw plates and cooperating flat surfaces of the walls 274, 308 of the extrusion thus provide strong, stable mounting points for their respective components, which can be installed rapidly during assembly of the machine, which offer superior long-term durability as opposed the relatively soft material of the light-weight aluminum extrusion. Moreover, the internal location of the channels, being enclosed by an outer wall 310 of the extrusion, covers the plates and the bolt ends so as to provide improved ascetics and avoid protrusions on which items might catch, and also protects the raw surfaces of the steel plates against long-term corrosion.

The upper chamber 292 of the extrusion, in turn includes a longitudinally extending, generally cylindrical channel or bore 312 that is defined by walls 314 and 316. The bore 312 can be tapped from the cut end of the extrusion, thus providing an attachment point for longitudinal mounting bolts (not shown) from the end assemblies. The semi-enclosed configuration (as opposed to a completely enclosed bore) renders it easier to form this feature effectively during the extrusion process.

e. Additional Embodiment

Figure 24:
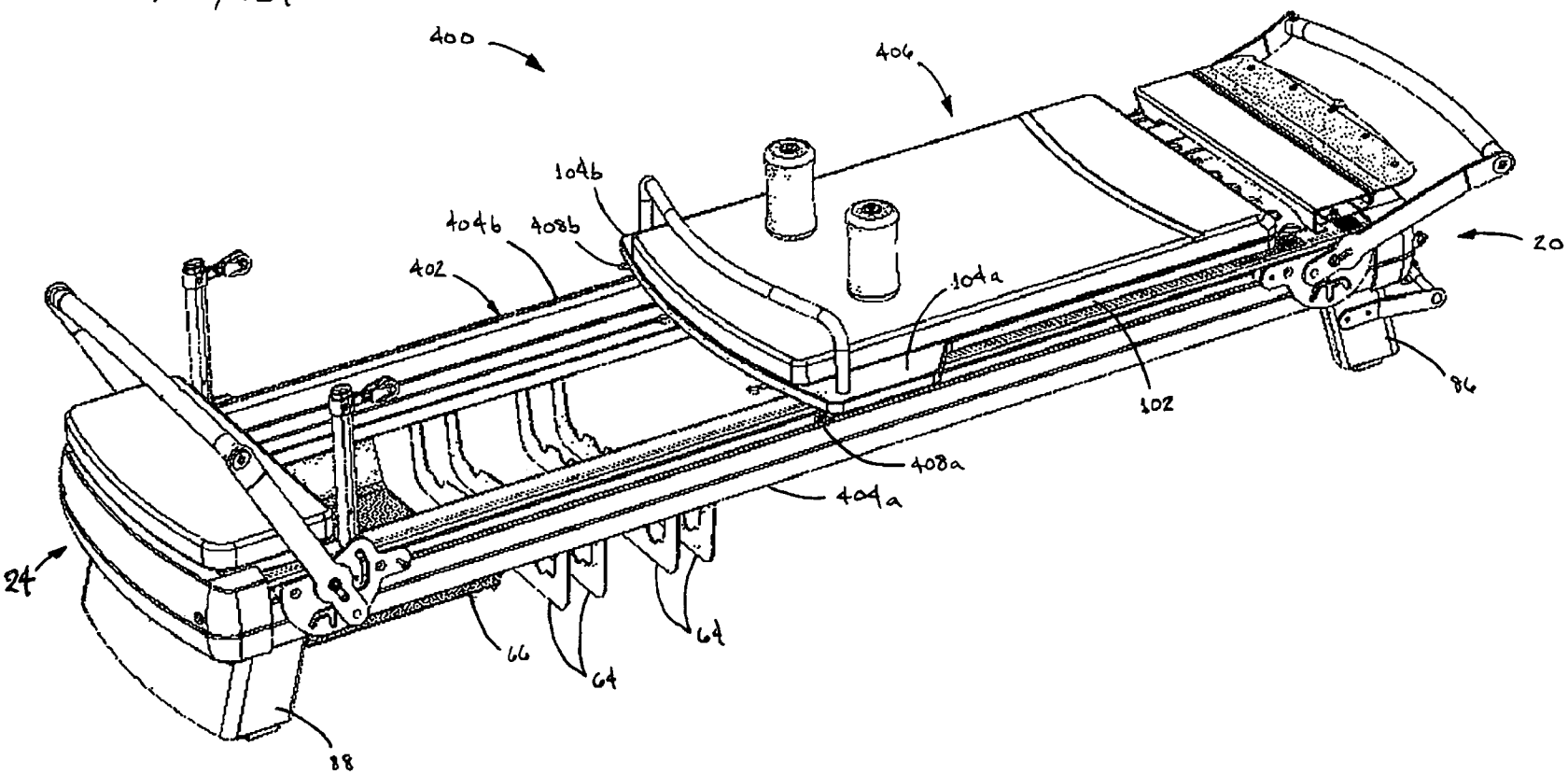
FIG. 24 is a perspective view of an exercise machine in accordance with another preferred embodiment of the present invention, in which certain aspects of the machine are simplified for economical manufacture and other benefits.

FIG. 24 shows an exercise machine 400 in accordance with another preferred embodiment of the present invention, that provides the bulk of the functional benefits of the embodiment described above but is simplified in some aspects, which both reduces cost and increases desirability, especially for use in a demanding environment such as a commercial exercise studio. Those components that are the same as in the embodiment described above will be referred to by like reference terminals in FIGS. 24-30.

As can be seen, exercise machine 400 includes a frame assembly 402 made up of side rails 404*a*, 404*b*, which are the same as described above except for having holes for mounting the bar assemblies in fixed locations only, rather than having a series of bores that allow the bracket assemblies to be positioned at multiple locations as described above. Similarly, the rail members are joined at the ends of the frame assembly by foot-and-head end assemblies 20, 24 supported on legs 86, 88, in the manner described above.

The platform assembly 406 is likewise generally similar to that described above, except that the main panel 102 of the carriage lacks the angled flanges previously described; instead the ends of the ropes are attached directly to the lateral wing extensions 104*a*, 104*b* at the head end of the panel, by means of simple, longitudinally extending eye pieces 408*a*, 408*b*, in place of the cam cleats previously described. The simplified construction lacks the ease of adjustment of the above embodiment, however, this loss is offset by lower cost and greater durability, especially in a studio environment, in which severe high-hour usage may lead to the ropes being damaged by repeated engagement by the cam cleats and also to breakage/failure of the cleats themselves.

Figure 25:
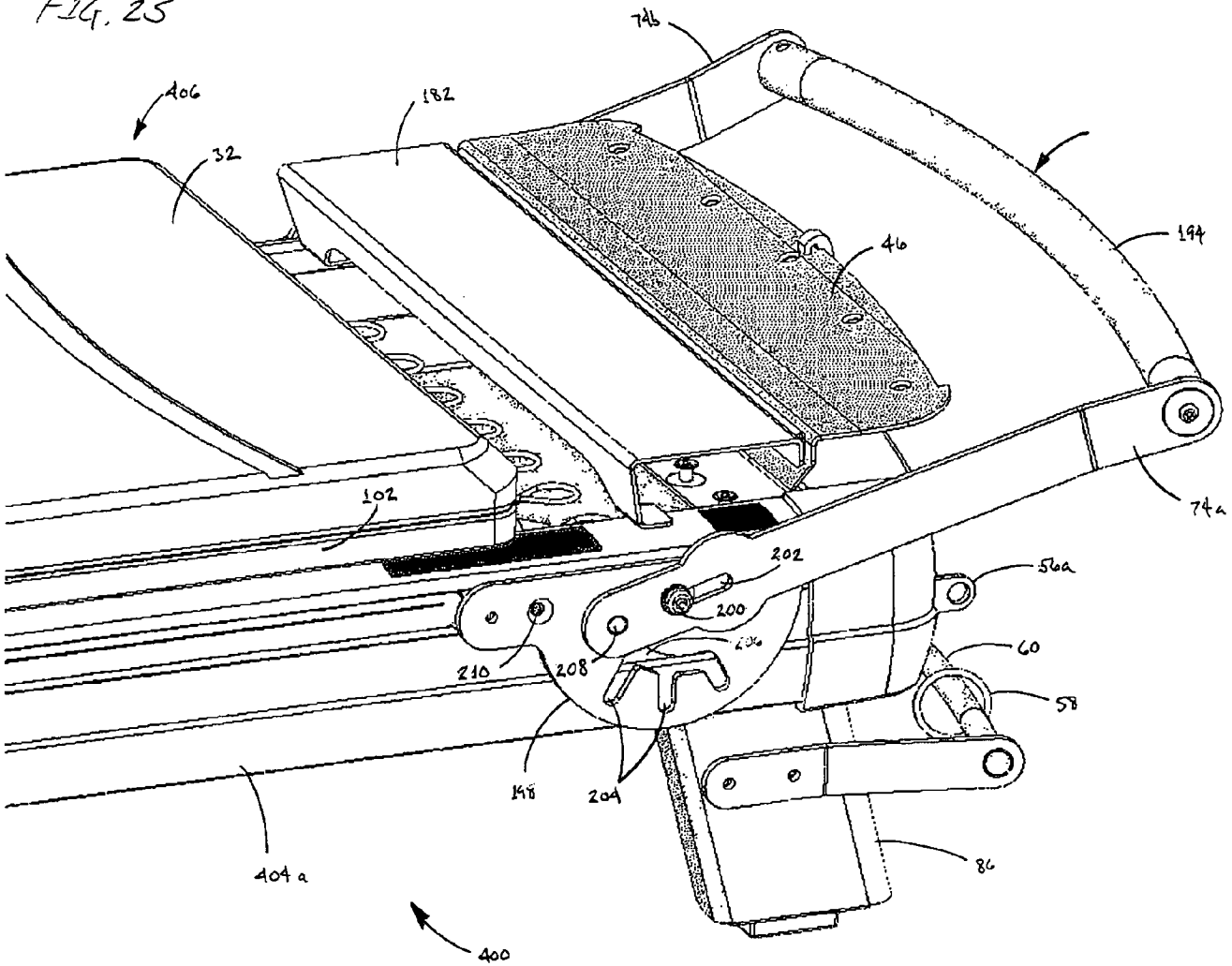
FIG. 25 is a partial, perspective view of the foot end portion of the exercise machine of FIG. 24, showing the adjustable bar and related components in greater detail.
Figure 26:
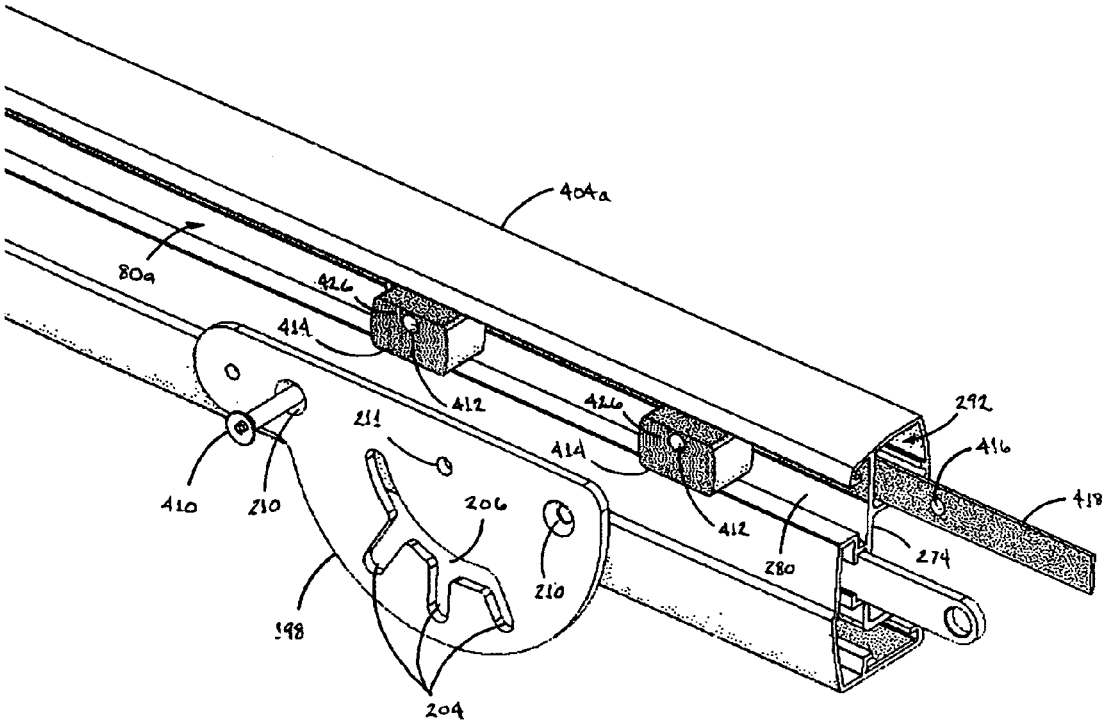
FIG. 26 is a perspective, partially exploded view of a foot end portion of one of the side rails of the exercise machine of FIGS. 24-25 and the bracket of the adjustable bar, showing the manner in which the bar assembly mounts to the frame rail in greater detail.
Figure 27:
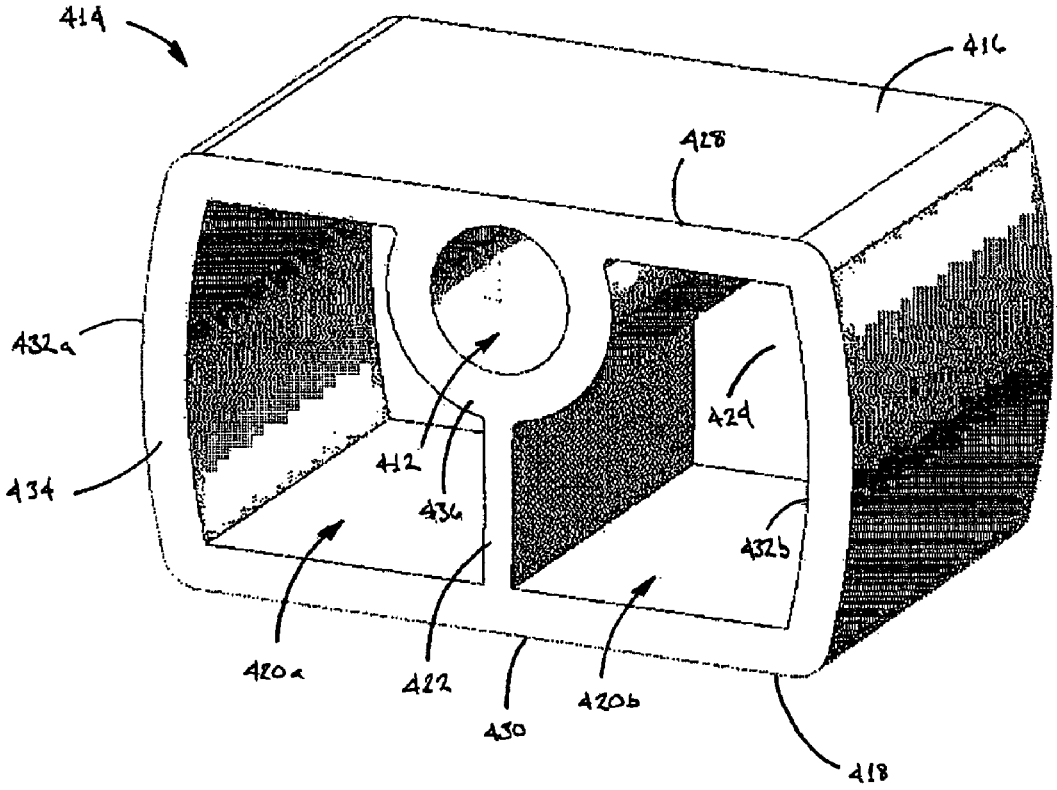
FIG. 27 is an enlarged perspective view of one of the spacer pieces in part in mounting the adjustable bar bracket to the frame rail as shown in FIG. 26.

As noted, the embodiment shown in FIG. 24 also lacks the longitudinally adjustable foot/hand bar assemblies. Instead, as can be seen in FIGS. 25-27, the bar assemblies are mounted in fixed locations, using bolts (not shown in FIG. 25) that pass through, and are secured in, cooperating bores in the mounting plates and side rails. As can be seen in FIG. 26, the quadrant plates 198 of the bar assemblies are the same as previously described, and include arcuate and radial slots 206, 204 that cooperate with the indexing pins 208 on the lower ends of arms 74*a*, 74*b* to permit angular adjustment of the bar. Similarly, the quadrant plates include first and second horizontally-aligned mounting bores 210, as well as bores 211 that accommodates the bolts 200 that form the pivot pins of the arms.

However, in contrast to the mounting arrangement shown in FIGS. 1 and 17, which permits longitudinal adjustment of the bar assemblies within the outer guide slots of the side rails, in the embodiment of FIGS. 24-30 the quadrant plates 198 are fixed in place, by bolts 410 that pass through the bores in the plates and cooperating bores (not shown) in the vertical web 274 of the extrusion. The bolts also pass through cooperating bores 412 in short spacer blocks 414 that are placed in the channel 80*a* behind the quadrant plate, while the threaded ends of the bolts are received in cooperatingly threaded bores 416 formed in a short bar 418 that is inserted in the upper cavity 292 of the extrusion on the opposite side of web 274.

As can be seen in FIG. 27, the spacers 414 are short, block-shaped pieces that are sized to fit closely within the outer channels of the side rails, with the vertical height between the parallel upper and lower surfaces 416, 418 being approximately equal to or just slightly greater than that of the channel 0 so as to press tightly against the horizontal upper and lower walls thereof (see FIG. 23). In the interest of reduced cost and ease of molding, the spacer pieces are preferably hollow rather than solid, with interior cavities 420*a*, 420*b* separated by a vertical, front-to-back web 422. A vertical wall 424 at the forward side of the block forms the front surface 426 of the spacer piece, while a flat rim along the rearward edges of walls 428 and 432*a*, 432*b* forms the back surface 434 of the spacer. A generally cylindrical sleeve portion 436, formed at the juncture between web 422 and the upper wall 428, in turn encloses the through bore 412.

The spacer blocks 414 are suitably formed of rigid, substantially incompressible injection molded plastic. The structure that is shown in FIG. 27 provides particular advantages, in this context, in terms of both strength and economy of manufacture, but it will be understood that spacer pieces having other configurations may also be used. For example, the forward wall 424 may be omitted and the pieces formed of a plastic or metal extrusion cut to length, or they may be solid blocks having the bores 412 drilled or otherwise formed therethrough.

Because the sides of the spacer pieces 414 are flat and lack flanges or other features to engage the upper and lower channels 282, 284 of the guide channels (see again FIG. 23), they can be installed by simply being pressed or forced into the channel 80*a* from the side, rather than having to be slid longitudinally into position from the end; not only is does this make assembly quicker and easier, but the upper and lower surfaces 416, 418 of the blocks are able to form a tight, stable interfit with the upper and lower walls of the channel, since there is no need to allow sufficient clearance to permit the pieces to be slid through the channels.

Thus, when mounting the arms, the spacer pieces are simply pressed or tapped into place, and then the bolts are passed through the co-aligned bores in the plates and spacers and the vertical web of the extrusion, and then threaded into the bores of the bar 416 behind the opposite side of the web. As the bolts are then tightened, the plates 198 are drawn towards the threaded bars, acting to clamp the spacer blocks between the plates and the rail members. As the spacers are squeezed between these members, the vertical front surfaces press against the flat rear surfaces of plates 198, while the back surfaces 434 of the spacers press against the vertical wall 280 at the rear of the guide channel 80*a*. The firm engagement of the various surfaces thus stabilizes the quadrant plates 198 and holds them firmly in place, virtually eliminating any movement or "slop" between the bar assemblies and the frame during use of the machine.

As compared with the longitudinally adjustable bar assemblies, it has been found that the fixed arrangement shown in FIGS. 24-26 enjoys significant advantages in terms of the strength, rigidity and durability, especially when subjected to strenuous, high-hour usage in a studio environment; for example, the use of steel mounting bolts 410 and steel threaded bars 418, in conjunction with rigid plastic spacer pieces 414, eliminates wear on the comparatively soft aluminum alloy material of the rail members that could otherwise lead to looseness between the components.

Figure 28:
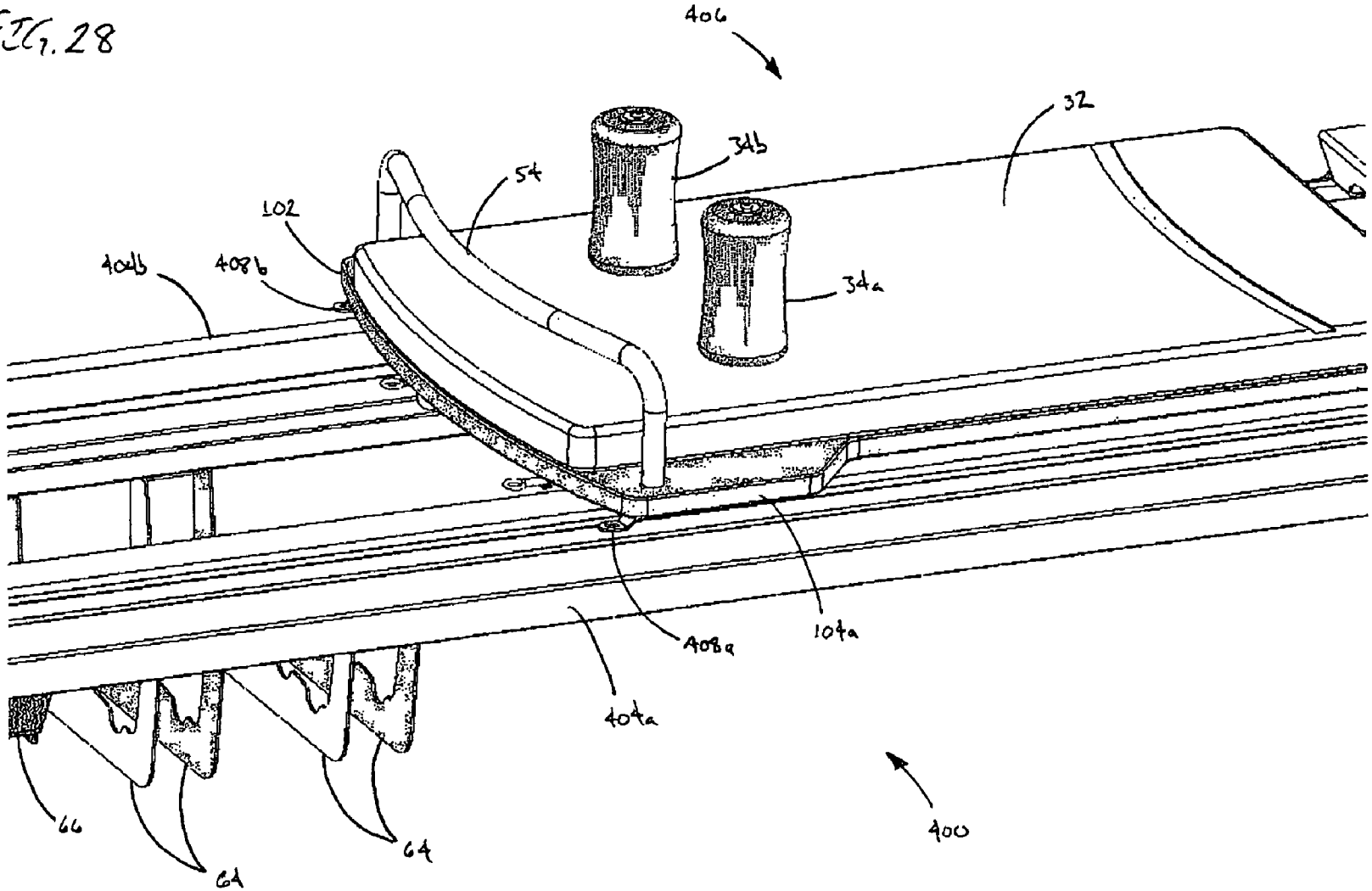
FIG. 28 is a partial, perspective view of the upper side of the platform assembly of the exercise machine of FIG. 24.
Figure 29:
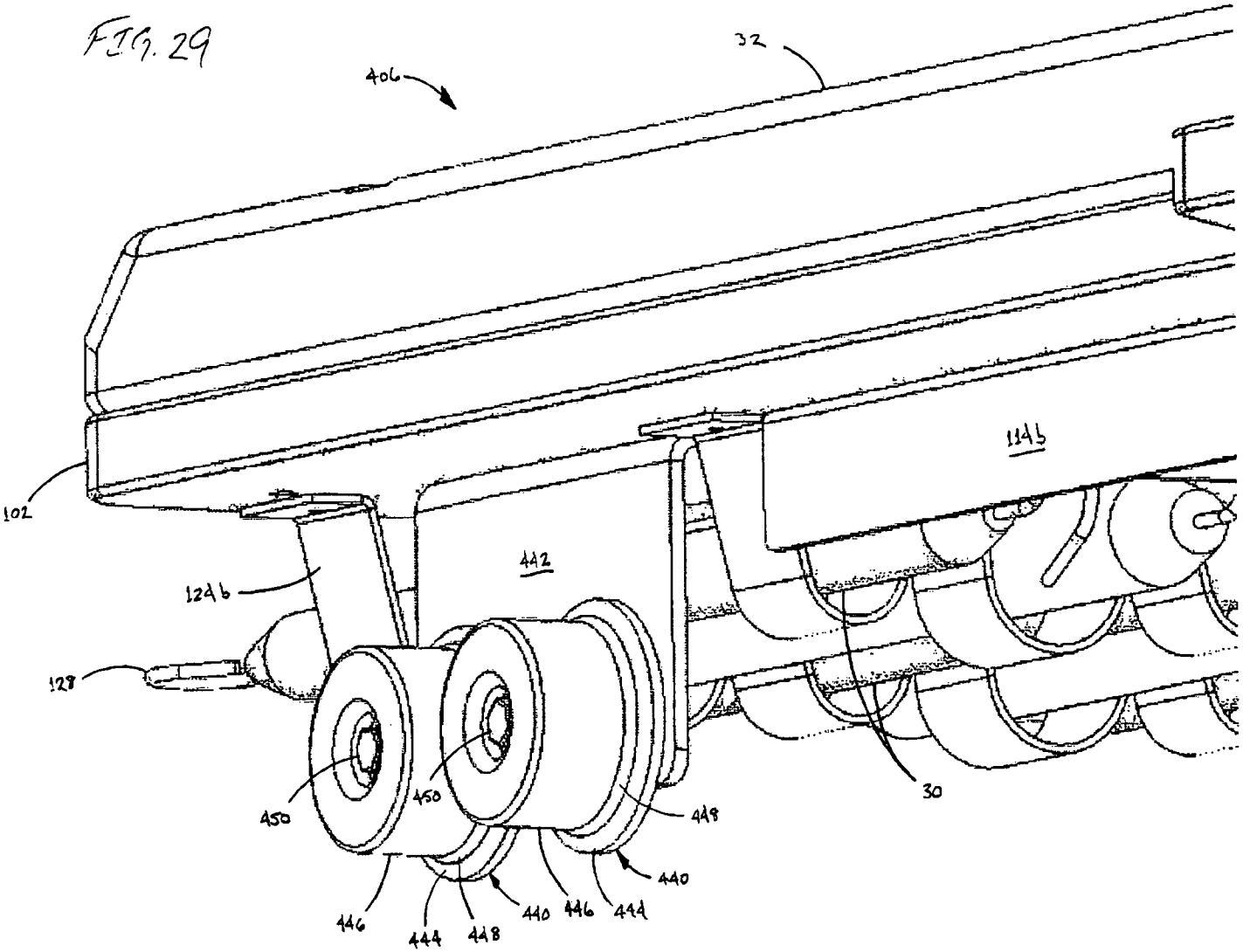
FIG. 29 is a partial, perspective view of the lower side of the carriage assembly of FIG. 28, showing one of the roller assemblies that support the corners of the carriage assembly for longitudinal rolling movement on the side rails of the frame assembly.

FIGS. 28-29 show the carriage assembly 406 in greater detail. As noted above, the upper side of the platform is essentially the same as described with preference to FIG. 1, except for the absence of the angled flanges from the wing portion 104*a*, 104*b* of the rigid panel 102, and the use of hard eyes 408*a*, 408*b* in place of the cam cleats.

However, rather than the combination of horizontal and vertical axis wheels used in the embodiment of FIG. 1, the carriage 406 rides solely on horizontal axis wheels. As can be seen in FIG. 29, the horizontal axis wheels are in the form of flanged rollers 440, preferably mounted in pairs at each corner of the platform on angle brackets 442. Each of the rollers includes a radially extending base flange 444 with a radius or shoulder forming a transition 448 between the flange and body. As can be seen in FIG. 29, the rollers are mounted on the outboard sides of the brackets 442, by axle bolts 450, so that the base flanges are disposed inwardly towards the longitudinal center line of the machine, and the cylindrical body portions extend outwardly therefrom along a horizontal axis normal to the center line.

Figure 30:
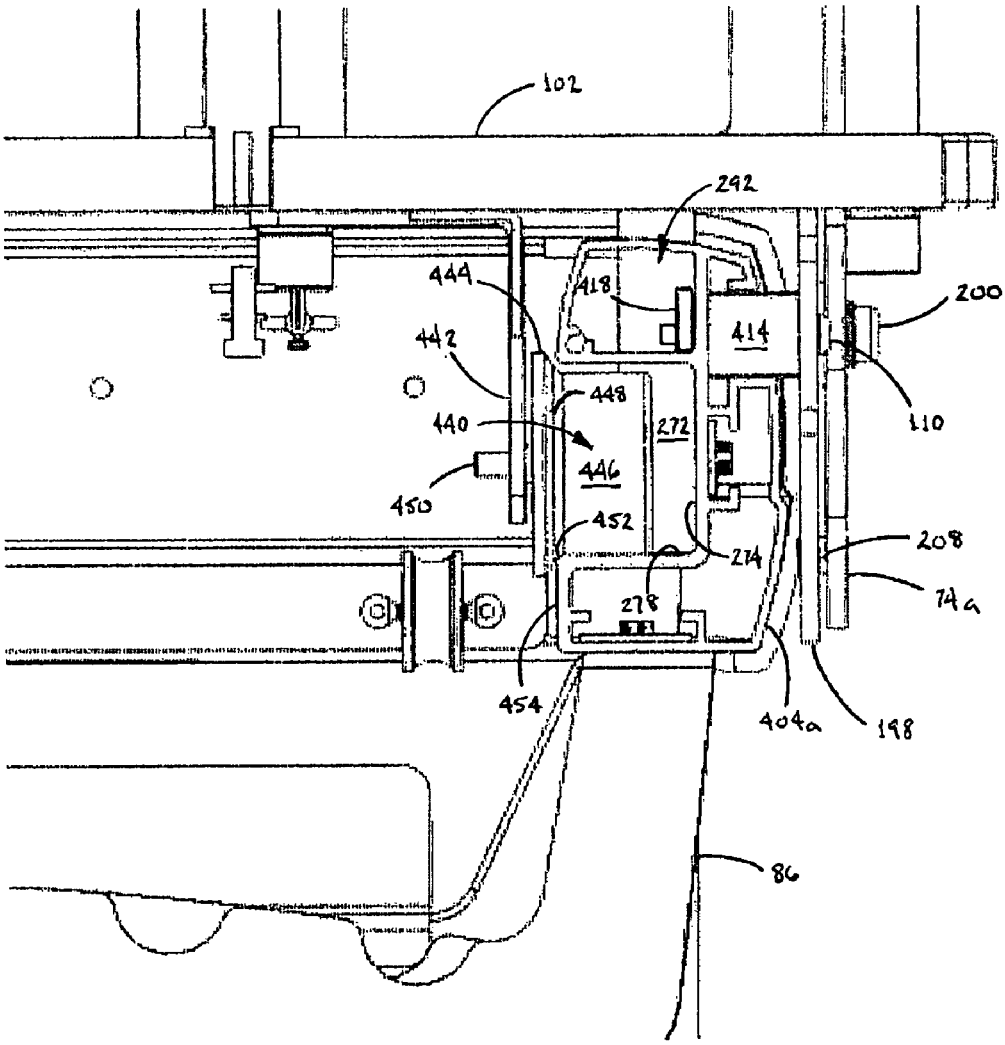
FIG. 30 is a cross-sectional view taken through one of the side rails of the exercise machine of FIG. 24, showing the relationship of the roller wheels of the carriage assembly and the brackets and mounting spacers of the adjustable bar assemblies thereto in greater detail.

As can be seen in FIG. 30, the horizontal axis rollers 440 are positioned and sized to be received in the inboard guide channels 272 of the frame rails 404*a*, 404*b*, so that the cylindrical bodies of the rollers are supported for longitudinal rolling movement on the lower walls 278 of the channels. The flange portions 448, in turn, engage the corner 452 of the extrusion, between the horizontal lower wall 278 of the guide channel and the vertical wall 454 that extends downwardly therefrom, so that the lower reach of the flange is disposed adjacent wall 454 of the extrusion. FIG. 30 shows only one side of the assembly, and it will be understood that another pair of rollers is located on the other side of the carriage directly opposite those shown, fitting into the channel 272 of the opposite rail member 404*b* in mirror image relationship to that shown in FIG. 30.

Lateral movement of the carriage is therefore limited by the flange portions of the rollers, reacting against the inboard surfaces of the walls 454 of the rails on opposite sides of the frame, with the radiused shoulders 448 of the rollers providing a self-centering action that tends to move the carriage towards the longitudinal center line of the machine and align it therewith, and also prevents the flanges 444 from rubbing constantly against the surfaces of the rail members; in this regard, it will be understood that FIG. 3 shows the rollers 440 at the inward limit of travel into the guide channel 272, and that the transverse spacing between the rollers on opposite sides of the carriage is preferably such that a slight gap will be maintained between the flanges and the inside surfaces of the rails when the carriage is centered, so that the weight will normally be supported solely on the cylindrical bodies of the rollers and the flanges will only occasionally make contact the rail members.

The flanged rollers 440 are suitably formed of a polyurethane material having a suitable hardness, however, it will be understood that other materials (e.g., rubber or other plastics) may also be used. It will also be understood that single rollers may be used at the corners of the platform rather than the dual roller configuration shown in FIG. 29, although the lateral has been found to provide a particularly smooth rolling action when supporting the weight of a user. It will also be understood that other forms of flanged or track rollers may also be used, in addition to or in place of the plain flanged rollers that are shown.

As compared with the combination horizontal and vertical axis wheel assemblies described previously, the horizontal axis roller assemblies of the embodiment shown in FIGS. 24-30 provides several significant advantages, including lower cost, better load distribution and reduced wear; fewer different parts, a better self-centering action, and the ability to accommodate variations in width between the rails without having to make adjustments to the wheels; on the other hand, the combination horizontal/vertical axis wheels may exhibit a slightly lower degree of rolling resistance, due to absence of the friction that results from occasional contact of the flanged and radius portions of the rollers with the rails of the frame.

It is to be recognized that various alterations, modifications, and/or additions may be introduced into the constructions and arrangements of parts described above without departing from the spirit or ambit of the present invention.

What is claimed is:

1. An exercise machine, comprising:

a generally horizontal frame comprising first and second spaced-apart, substantially parallel frame rails;

a carriage assembly mounted for longitudinal movement on said frame and having a carriage platform on an upper side thereof, at least one tension member that yieldingly biases the carriage assembly towards a foot end of said frame;

a first foot platform mounted at said foot end of said frame;

a second foot platform mounted at an opposite, head end of said frame;

a first angularly adjustable transverse bar mounted to said frame proximate said foot end thereof; and a second angularly adjustable transverse bar mounted to said frame proximate said head end thereof;

said first and second angularly adjustable transverse bars mounted to said frame each comprising:

a generally horizontal transverse bar member;

first and second parallel, pivotable arm members having upper ends mounted to ends of said transverse bar member and lower ends mounted to pivot axes at opposite sides of said frame, said lower ends of said arm members being radially slideable relative to said pivot axes;

first and second quadrant plates mounted to said opposite sides of said frame, said quadrant plates each comprising a plurality of spaced apart indexing slots extending generally about said pivot axes and an arcuate connecting slot communicating between said indexing slots; and first and second indexing pins mounted to said lower ends of said pivotable arm members that are received in said slots of said quadrant plates;

so that said transverse bar member is adjustable by sliding said arm members upwardly to raise said indexing pins out of a first pair of said indexing slots at a first angular position, pivoting said arm members to move said indexing pins through said connecting slots, and sliding said arm members downwardly to lower said indexing pins into a second pair of said indexing slots at a second angular position.

2. The exercise machine of claim 1, further comprising:

first and second ropes having first ends that are attached to said carriage assembly and second, free ends for being pulled by a user;

paired pulleys mounted in vertically-spaced relationship on first and second stanchions located proximate said head end of said frame over which said ropes are routed so that said user can exercise by pulling on second ends of said ropes against tension offered by the at least one tension member; and first and second angled axis pulley wheels mounted to said frame on opposite sides thereof, over which said ropes may be selectively routed so as to position said second, free ends thereof at locations that are angled outwardly from said platform of said carriage assembly.

3. The exercise machine of claim 2, further comprising:

first and second horizontal axis pulley wheels mounted to said frame on opposite sides thereof at locations proximate said angled axis pulley wheels, over which said ropes may be selectively routed so as to position said second, free ends thereof at locations that are adjacent said platform of said carriage assembly.

4. The exercise machine of claim 1, further comprising:

at least one barbell rack that is mounted transversely across said frame rails so as to be positioned generally beneath said horizontal frame of said machine said at least one barbell rack comprising:

first and second depending plate members mounted under said frame rails in spaced, substantially parallel relationship; and a plurality of cutouts formed in upwardly disposed edges of said depending plate members for receiving handle portions of barbells therein.

5. The exercise machine of claim 4, wherein said at least one barbell rack is mounted proximate said head end of said frame, so as to be accessible vertically through said frame when said carriage assembly is retracted to said foot end of said machine by said at least one tension member.

6. The exercise machine of claim 1, further comprising:

a storage tray that is mounted transversely across said frame rails so as to be positioned generally beneath said horizontal frame of said machine proximate said head end thereof, said storage tray comprising:

a depending, trough-shaped panel member mounted under said frame rails.

7. The exercise machine of claim 1, wherein said transverse bar on said head end of said carriage platform is spaced above said carriage platform to form a gap that is sized to permit a user's foot to be hooked under said transverse bar of said carriage platform while said foot is positioned on said carriage platform.

8. The exercise machine of claim 7, wherein said carriage assembly further comprises:

at least one traction pad mounted on said carriage platform proximate said transverse bar thereon, for forming an anti-slip engagement with said user's feet.

9. The exercise machine of claim 8, wherein said carriage assembly further comprises:

a second traction pad mounted to said carriage platform proximate a foot end thereof, for forming an anti-slip engagement with said user's feet.

10. The exercise machine of claim 1, wherein said carriage assembly further comprises:

first and second lateral extensions on opposite sides of said carriage platform; and at least one attachment feature on each of said lateral extensions for connection of said ropes thereto.

11. The exercise machine of claim 10, wherein said attachment features on said lateral extensions comprise:

eye members for fixed connection of said ropes thereto.

12. The exercise machine of claim 10, wherein said attachment features on said lateral extension comprise:

cam cleats and fair leads for adjustable connection of said ropes thereto.

13. The exercise machine of claim 10, wherein said lateral extensions on opposite sides of said platform comprise:

outwardly and downwardly angled flange portions having said attachment features mounted on undersides thereof, so as to avoid obstructing arm movements when said user is on said platform.

14. The exercise machine of claim 1, wherein said at least one tension member comprises:

a plurality of coil tension springs that interconnect said carriage assembly and said foot end of said frame, said plurality of coil tension springs comprising:

a plurality of larger and smaller coil springs mounted in alternating relationship; and a plurality of posts mounted at spaced locations across said foot end of said frame over which said attachment loops are removably placed so as to detachably connect said coil tension springs individually to said foot end of said frame, so as to enable a user to precisely adjust total tension on said carriage assembly by selectively connecting and disconnecting said larger and smaller coil springs from said foot end of said frame.

15. An exercise machine, comprising:

a generally horizontal frame;

a carriage assembly mounted for longitudinal movement on said frame and having a carriage platform on an upper side thereof;

at least one tension member that yieldingly biases the carriage assembly towards a foot end of said frame;

a first foot platform mounted at said foot end of said frame;

a second foot platform mounted at an opposite, head end of said frame;

a first angularly adjustable transverse bar mounted to said frame proximate said foot end thereof;

a second angularly adjustable transverse bar mounted to said frame proximate said head end thereof;

first and second ropes having first ends that are attached to said carriage assembly and second, free ends for being pulled by a user; and pulleys mounted proximate said head end of said frame over which ropes are routed so that said user can exercise by pulling on said second ends of said ropes against tension offered by the at least one tension member;

said carriage assembly further comprising:

first and second lateral extensions on opposite sides of said carriage platform; and at least one attachment feature on each of said lateral extensions for connection of one of said ropes thereto.

16. The exercise machine of claim 15, wherein said attachment features on said lateral extensions comprise:

eye members for fixed connection of said ropes thereto.

17. The exercise machine of claim 15, wherein said attachment features on said lateral extension comprise:

cam cleats and fair leads for adjustable connection of said ropes thereto.

18. The exercise machine of claim 15, wherein said lateral extensions on opposite sides of said platform comprise:

outwardly and downwardly angled flange portions having said attachment features mounted on undersides thereof, so as to avoid obstructing arm movements when said user is on said platform.

19. The exercise machine of claim 1, wherein said lower ends of said arm members each comprise:

a bore that receives a pivot shaft mounted to said frame so as to permit said arm member to be pivoted thereon; and a slot extending downwardly from said bore that receives said pivot shaft to permit said arm member to be raised and lowered thereon.

20. An exercise machine, comprising:

a generally horizontal frame;

a carriage assembly mounted for longitudinal movement on said frame and having a carriage platform on an upper side thereof;

at least one tension member that yieldingly biases the carriage assembly towards a foot end of said frame;

a first foot platform mounted at said foot end of said frame;

a second foot platform mounted at an opposite, head end of said frame;

a first angularly adjustable transverse bar mounted to said frame proximate said foot end thereof; and a second angularly adjustable transverse bar mounted to said frame proximate said head end thereof;

said first and second angularly adjustable transverse bars each comprising:

a generally horizontal transverse bar member;

first and second parallel, pivotable arm members having upper ends mounted to ends of said transverse bar member and lower ends mounted to pivot axes at opposite sides of said frame, said lower ends of said arm members being radially slideable relative to said pivot axes;

first and second quadrant plates mounted to said opposite sides of said frame, said quadrant plates each comprising a plurality of spaced apart indexing slots extending generally about said pivot axes and an arcuate connecting slot communicating between said indexing slots; and first and second indexing pins mounted to said lower ends of said pivotable arm members that are received in said slots of said quadrant plates;

so that said transverse bar member is adjustable by sliding said arm members upwardly to raise said indexing pins out of a first pair of said indexing slots at a first angular position, pivoting said arm members to move said indexing pins through said connecting slots, and sliding said arm members downwardly to lower said indexing pins into a second pair of said indexing slots at a second angular position.

21. The exercise machine of claim 20, wherein said lower ends of said arm members each comprise:

a bore that receives a pivot shaft mounted to said frame so as to permit said arm member to be pivoted thereon; and a slot extending downwardly from said bore that receives said pivot shaft to permit said arm member to be raised and lowered thereon.

22. An exercise machine, comprising:

a generally horizontal frame comprising first and second spaced-apart, substantially parallel frame rails;

a carriage assembly mounted for longitudinal movement on said frame and having a carriage platform on an upper side thereof;

at least one tension member that yieldingly biases the carriage assembly towards a foot end of said frame;

at least one foot platform mounted at an end of said frame; and an angularly adjustable transverse bar mounted to said frame proximate an end thereof, said angularly adjustable transverse bar comprising:

a generally horizontal transverse bar member;

first and second parallel, pivotable arm members having upper ends mounted to said transverse bar member and lower ends mounted to pivot axes at opposite sides of said frame, said lower ends of said arm members being radially slideable relative to said pivot axes;

at least one quadrant plate mounted to one of said sides of said frame, said quadrant plate comprising a plurality of spaced apart indexing slots extending generally about one of said pivot axes and an arcuate connecting slot communicating between said indexing slots; and an indexing pin mounted to at least one of said lower ends of said pivotable arm members that is received in said slots of said quadrant plate;

so that said transverse bar member is adjustable by sliding said arm members upwardly to raise said indexing pin out of a first one of said index slots at a first angular position, pivoting said arm members to move said indexing pin through said connecting slot, and sliding said arm members downwardly to lower said indexing pin into a second one of said indexing slots at a second angular position.

23. The exercise machine of claim 22, wherein said at least one of said lower ends of said arm members comprises:

a bore that receives a pivot shaft mounted to said frame so as to permit said arm member to be pivoted thereon; and a slot extending downwardly from said bore that receives said pivot shaft to permit said arm member to be raised and lowered thereon.

24. The exercise machine of claim 22, further comprising:

a second foot platform mounted at an opposite end of said frame.

* * * * *